US005881413A

United States Patent [19]

Throneburg et al.

[11] Patent Number: 5,881,413

[45] Date of Patent: Mar. 16, 1999

[54] SHOE LAST AND METHOD OF CONSTRUCTING A SHOE

[75] Inventors: James L. Throneburg, 625 W. Bell St., Statesville, N.C. 28687; James G. McLelland, Statesville, N.C.; Victor J. Gallenstein, Maysville, Ky.; Leon E. Kelley, Needham, Mass.; Douglas H. Richie, Long Beach, Calif.

[73] Assignee: James L. Throneburg, Statesville, N.C.

[21] Appl. No.: 672,585

[22] Filed: Jun. 28, 1996

Related U.S. Application Data

[63] Continuation-in-part of Ser. No. 35,482, Feb. 28, 1995.

[51] Int. Cl.[6] ..... A43D 3/00

[52] U.S. Cl. ..... 12/133 B; 12/128 R; 12/133 R

[58] Field of Search ..... 12/128 R, 133 R, 12/134, 133 B

[56] References Cited

U.S. PATENT DOCUMENTS

| | | | |
|---|---|---|---|
| 81,014 | 8/1868 | Schmitt . | |
| 106,030 | 8/1870 | Burke . | |
| 245,306 | 8/1881 | Miller | 12/133 R |
| 540,897 | 6/1895 | Blake | 12/133 R |
| 1,410,324 | 3/1922 | Kreidler . | |
| 1,586,120 | 5/1926 | Saklad | 12/133 R |
| 1,587,496 | 6/1926 | Altieri | 12/133 R |
| 1,660,763 | 2/1928 | Parker . | |
| 1,688,065 | 10/1928 | Wolfer | 12/133 R |
| 1,756,587 | 4/1930 | Durkee | 12/133 R |
| 1,778,580 | 10/1930 | Blakely . | |
| 1,930,304 | 10/1933 | Brown et al. | 12/133 R |
| 1,936,399 | 11/1933 | Marca . | |
| 1,971,108 | 8/1934 | Karow . | |
| 1,987,745 | 1/1935 | Loewer . | |
| 1,989,350 | 1/1935 | Cooper | 12/133 R |
| 2,000,340 | 5/1935 | Marca et al. . | |
| 2,026,620 | 1/1936 | Finn . | |
| 2,044,676 | 6/1936 | Fikany . | |
| 2,062,557 | 12/1936 | Clark . | |
| 2,091,387 | 8/1937 | Diller . | |
| 2,119,590 | 6/1938 | MacDonald . | |
| 2,247,818 | 7/1941 | Nast . | |
| 2,266,369 | 12/1941 | Kohn . | |
| 2,320,732 | 6/1943 | Lafferty | 12/133 R |
| 2,465,817 | 3/1949 | Perugia . | |
| 2,498,037 | 2/1950 | Greenan . | |
| 2,597,197 | 5/1952 | Stacey . | |
| 2,737,671 | 3/1956 | Hill . | |
| 2,805,432 | 9/1957 | Riggs | 12/133 B |
| 2,955,326 | 10/1960 | Murray . | |
| 3,241,166 | 3/1966 | Jonas . | |
| 3,320,347 | 5/1967 | Greenwalt . | |
| 3,543,316 | 12/1970 | Austin et al. | 12/133 R |
| 3,673,623 | 7/1972 | Zohar . | |
| 3,724,014 | 4/1973 | Bennett et al. . | |
| 3,790,978 | 2/1974 | Condamine et al. . | |

(List continued on next page.)

FOREIGN PATENT DOCUMENTS

| | | | |
|---|---|---|---|
| 62940 | 10/1940 | Norway | 12/133 R |
| 6410 | of 1915 | United Kingdom | 12/133 R |
| 19633 | 10/1993 | WIPO | 12/133 R |

*Primary Examiner*—M. D. Patterson
*Attorney, Agent, or Firm*—Bell Seltzer Intellectual Property Law Group of Alston & Bird LLP

[57] ABSTRACT

A shoe last and method for forming a shoe which is particularly constructed to be worn with and matingly interface with a wearer's custom-shaped sock. The shoe last includes a body having a backpart and a forepart connected to the backpart and extending forwardly therefrom. The last has a last bottom portion for abuttingly contacting and interfacing with a sole of a shoe. The last bottom portion has a bottom shape corresponding to the bottom shape of a custom-shaped sock when positioned on the foot of a wearer. The sole of a shoe formed from the last has a custom-contoured shape corresponding to and substantially mating with an overlying custom-shaped sock when positioned therein.

31 Claims, 11 Drawing Sheets

U.S. PATENT DOCUMENTS

| | | | |
|---|---|---|---|
| 3,860,986 | 1/1975 | Ballard . | |
| 3,877,100 | 4/1975 | Harvey . | |
| 3,881,205 | 5/1975 | Funck . | |
| 3,991,430 | 11/1976 | Gumbs . | |
| 4,044,417 | 8/1977 | Cohen . | |
| 4,286,348 | 9/1981 | White, Sr. | 12/133 R |
| 4,305,212 | 12/1981 | Coomer . | |
| 4,306,361 | 12/1981 | Kaschura . | |
| 4,412,364 | 11/1983 | Orea Mateo . | |
| 4,523,345 | 6/1985 | Orea Mateo . | |
| 4,716,662 | 1/1988 | Bar . | |
| 4,741,062 | 5/1988 | Blanc et al. . | |
| 4,817,222 | 4/1989 | Shafir . | |
| 4,817,305 | 4/1989 | Wetzel . | |
| 4,831,750 | 5/1989 | Müller . | |
| 4,884,309 | 12/1989 | Shafir . | |
| 4,906,425 | 3/1990 | Poussou . | |
| 5,018,233 | 5/1991 | Waterfield et al. . | |
| 5,054,147 | 10/1991 | Motsch . | |
| 5,228,164 | 7/1993 | Graf et al. . | |
| 5,231,723 | 8/1993 | White et al. . | |
| 5,595,005 | 1/1997 | Throneburg et al. | 36/10 |

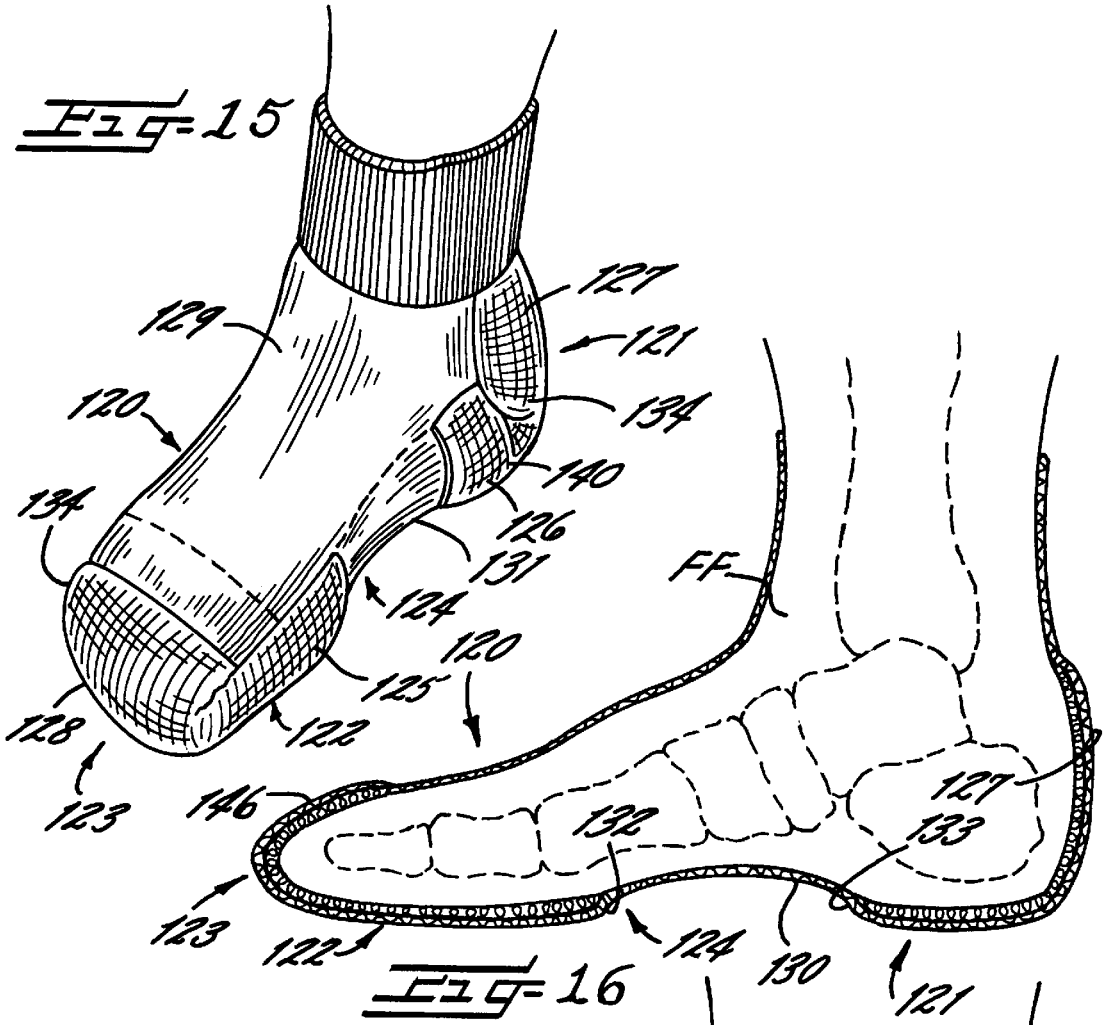
Fig-15
127
121
129
134
120
140
134
126
131
124
FF
120
125
128
122
123
146
132
127
133
123
122
124
130
121
Fig-16
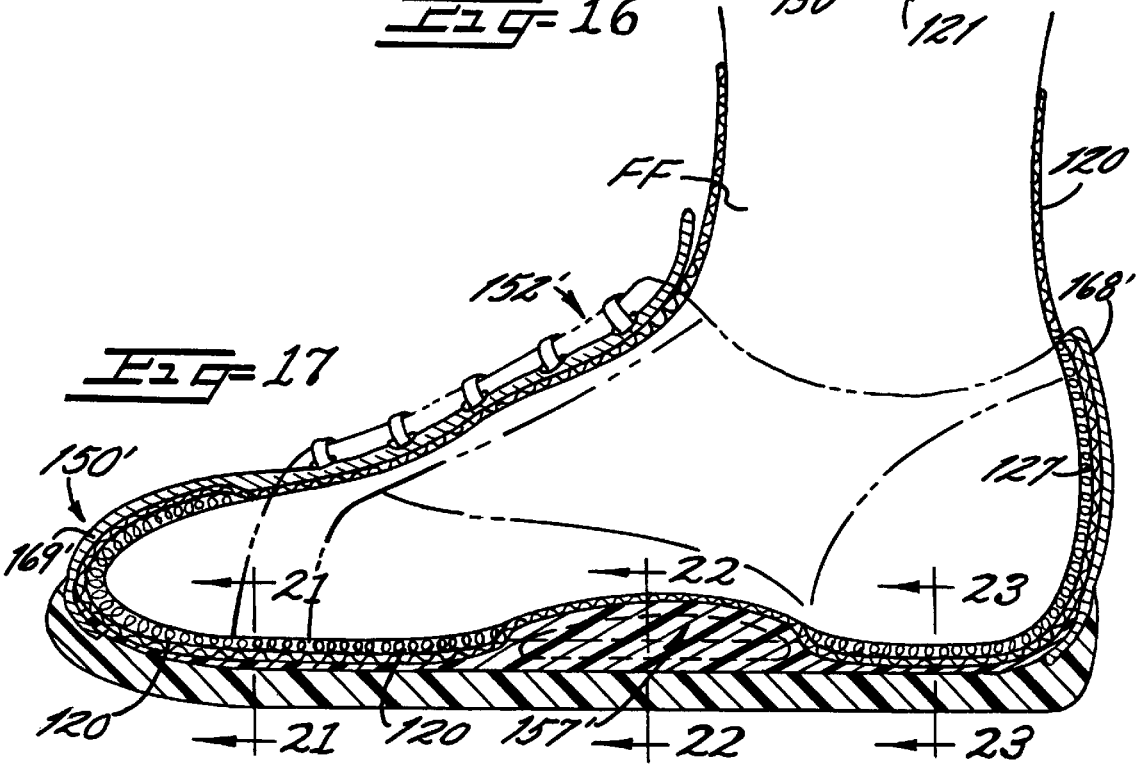
FF
120
152'
168'
Fig-17
150'
127
169'
21
22
23
120
21
120
157'
22
23

SHOE LAST AND METHOD OF CONSTRUCTING A SHOE

RELATED APPLICATION

The present application is a continuation-in-part of co-pending application Ser. No. 29/035,482, filed on Feb. 28, 1995, which is hereby incorporated in its entirety by reference.

FIELD OF THE INVENTION

The present invention is directed to shoe lasts for constructing a shoe and a related method of shoe construction.

BACKGROUND OF THE INVENTION

Traditional shoe lasts have been widely used as both a model and a form to construct mass-produced shoes designed to fit a broad range of the feet of a given population. These traditional shoe lasts have mimicked a universal human foot based on generalized length, width, and girth measurements of the foot.

Traditional lasts are typically produced by constructing a model last for a particular shoe style, for example a women's 6B for a dress shoe. Last makers then grade shoe lasts between sizes in lengths and widths starting from this model last utilizing accepted grading systems. Well-known last grading systems include: arithmetic; geometric; and proportional. These grading systems utilize proportional or standardized measurements at various grading points to. move between length sizes and width sizes in a particular style of shoe last. Texts such as Karl C. Adrian, *American Last Making* (1991) explain some generally accepted grading points and measurements for length, width, and girth for shoe lasts. For example, generally accepted measurements are utilized for the length of the bottom of the last measured utilizing a last stick for a particular shoe style and size. Generally accepted girth measurements, including the instep girth, waist girth, and ball girth measurements, are also used for a traditional shoe last for a particular shoe style and category of wearer such as men, women, and children.

Although these lasts are used to manufacture mass-produced shoes to fit a "universal" foot, it is well known that configurations of human feet vary greatly from person to person and among different populations of the world. Mass-produced shoes made on traditional lasts fit poorly on many feet causing or contributing to various foot problems and discomfort. It has been recognized that many problems of comfort, wear and tear, and foot ulcerations are associated with walking, standing, or running in shoes.

Various approaches have been made in mass-produced shoe design and last design to increase comfort and reduce associated foot problems. One approach has been to incorporate extra support or cushioning in the innersole, shoe upper, midsole, and outer sole. Shoes have also been developed which have attempted to emulate the sole of the foot of the wearer to thereby provide a degree of comfort when walking, running or the like. The design of these shoes typically anticipated the wearer to use a conventional thin sock with the shoe so that the shoe innersole of the shoe substantially corresponds in size to the sole of the foot. Examples of such shoes may be seen in U.S. Pat. No. 4,831,750 by Müller entitled "Shoe-Construction, Shoe Construction Product, and Method of Fabricating the Products" and U.S. Pat. No. 4,305,212 by Coomer entitled "Orthotically Dynamic Footwear."

Last designs have also been modified to produce shoes which conform to various portions of the foot or allow for foot deformities or irregularities. See for example, U.S. Pat. No. 3,991,430 by Gumbs entitled "Shoe Last," U.S. Pat. No. 1,756,587 by Durkee entitled "Last," U.S. Pat. No. 2,044,676 by Finkany entitled "Shoe Last," and U.S. Pat. No. 106,030 by Burke entitled, "Boot or Shoe." Lasts have also been adapted to construct shoes with additional components such as steel toe plates for safety shoes as seen in U.S. Pat. No. 2,737,671 by Hill entitled "Last for Safety Shoes" and U.S. Pat. No. 2,498,037 by W. G. Greenan entitled "Last for Use in the Manufacture of Safety Shoes."

Sock manufacturers, including the common assignee for the present invention, have modified sock designs to increase the comfort and reduce stress on the feet when wearing shoes. For instance, the common assignee recognized that when wearing shoes, the major wear and tear on the foot occurs in the ball and heel regions of the foot because a major portion of the person's weight is distributed in these regions when standing, walking, or running. As a result of this recognition, Thorneburg, the common assignee, developed the sock disclosed in U.S. Pat. No. 4,194,249 entitled Jogging and Running Athletic Sock (hereinafter "the Thorneburg '249 patent") which is incorporated herein by reference. The sock seen in the Thorneburg '249 patent is a custom-shaped knit sock having an increased density of fabric in the ball and heel portions of the sock to provide added comfort to the wearer and to reduce the damage to these regions of the foot. Another custom-shaped sock may be seen in U.S. Pat. No. 5,335,517 to Throneburg et al. entitled Anatomical Isotonic Sock and Method of Knitting the Same (hereinafter "the Throneburg '517 patent") and incorporated by reference herein. The sock illustrated in the Throneburg '517 patent has varying terry loop density in the foot portion of the sock so as to provide a therapeutic and preventative benefit to the foot of the wearer.

Traditional lasts provide insufficient girth or volume, width, or length to produce a shoe which can accommodate a custom-shaped sock when positioned on the foot of a wearer and do not properly fit. Therefore, the therapeutic and comfort benefits of custom-shaped socks are reduced or eliminated by the poor fit of shoes constructed on a traditional last when positioned on the foot of a wearer of a custom-shaped sock.

Alternatively, a wearer may attempt to obtain a more comfortable fit by choosing a larger size of a shoe constructed with a traditional last. The result of wearing a larger shoe will be a poor fit because the relationship of the portions of the foot will not correspond to the elements of the shoe. For instance, the arch or the foot will be out of alignment or proportion with the arch portion of the innersole. Consequently, individuals attempting to obtain the benefits of a comfortable and cushioned fit must choose between not wearing a custom-shaped sock or wearing the custom-shaped sock in a shoe that is too large.

SUMMARY OF THE INVENTION

In view of the foregoing, the present invention provides a shoe last for constructing a shoe which has a shape corresponding to the shape of a human foot with a custom-shaped sock positioned thereon. A shoe constructed on the last of the present invention enables the wearer of a custom-shaped sock to experience the benefits and advantages of a custom-shaped sock, free of bunching and other problems associated with wearing custom-shaped socks with shoes designed on a traditional last.

These and other benefits, features, and advantages of the present invention are obtained by providing a shoe last used to construct a shoe having a sole and/or shoe upper having a custom-contoured shape corresponding to and substantially mating with an overlying and/or adjacent custom-shaped sock when positioned on a foot of a wearer. The last of the present invention also enables the shoe to have sufficient shape, girth or volume, length, and width to properly abuttingly contact and matingly interface with various portions of a custom-shaped sock positioned on the foot of a wearer with such shoe. As a result, a wearer having a custom-shaped sock and a shoe made by the last of the present invention obtains increased protection and enhanced comfort to the foot.

The shoe last has a body having a backpart and a forepart. A last bottom portion is defined by lower peripheries of the backpart and the forepart for abuttingly contacting and interfacing with a sole of a shoe. The last bottom portion includes a featherline for defining the shape thereof which substantially corresponds to the bottom shape of a custom-shaped sock when positioned on a foot of a wearer. The sole of a shoe formed from the last has a custom-contoured shape corresponding to and substantially mating with an overlying custom-shaped sock when positioned therein. As defined herein, sole is intended to include the footbed, innersole, midsole, and outersole, either individually and/or in any combination thereof.

One embodiment of the shoe last preferably includes bulging portions in various portions of the last bottom portion and/or the last upper portion corresponding to the shape of a human foot with a custom-shaped sock positioned thereon. These bulging portions may be provided in the last bottom portion in heel, ball, and toe portions thereof. These bulging portions have lower peripheries for abuttingly contacting and interfacing with respective portions of a sole for a shoe. The bulging portions preferably extend downwardly a predetermined distance proportionally corresponding to the downwardly extending thickened cushioned areas of a custom-contoured sock on the foot of a wearer.

A preferred embodiment of the shoe last also includes a recessed arch interface bulging portion connected to a proximal end of the heel interface bulging portion. The recessed arch interface bulging portion assists the sole in abuttingly contacting and interfacing with a raised arch portion of a custom-shaped sock worn by the wearer.

A preferred method of constructing a shoe on the shoe last of the present invention includes positioning an upper surface of a sole having a shape preferably corresponding to the bottom shape of a custom-shaped sock when positioned on a foot of a wearer, so as to abuttingly contact and matingly interface with a last bottom portion of a shoe last. The shoe last has a body having a last bottom portion defined by lower end peripheries, the last bottom portion having a shape corresponding to the bottom shape of a custom-shaped sock when positioned on a foot of a wearer. A shoe is then constructed by conventionally known methods and once complete, the shoe is removed from the last.

Alternatively, it is possible to construct a shoe having the desired objects, features, and advantages of the present invention by using an alternative embodiment of the last according to the present invention and levelers. This alternative embodiment of the last includes a last upper portion having a shape corresponding to the upper shape of a custom-shaped sock positioned on the foot of a wearer. The last also includes a substantially planar last bottom portion defined by lower end peripheries of the forepart and the backpart. The last bottom portion is adapted to receive one of a plurality of interchangeable levelers each having a shape corresponding to the bottom shape of a different custom-shaped sock positioned on the foot of a wearer.

A corresponding method of construction includes positioning an upper surface of at least one leveler so as to abuttingly contact and matingly interface with the planar last bottom portion such that the last bottom portion and the at least one leveler define a shoe-forming bottom having a shape corresponding to the bottom shape of a custom-shaped sock when positioned on a foot of a wearer. A sole is then positioned so as to abuttingly contact and matingly interface with the last bottom portion and the lower surface of the at least one leveler. After which, a shoe is constructed having the sole for abuttingly contacting and matingly interfacing with a custom-shaped sock when positioned on the foot of a wearer.

Shoes constructed using the shoe last of the present invention allow for a wearer to use a custom-shaped sock having thickened heel and ball portion and thinner arch portions. When such a sock is worn in a shoe constructed on a last of the present invention, the sock is positioned so as to abuttingly contact and matingly interface with the sole of a shoe. As a result, the wearer obtains a comfortable fit as well as obtaining the health benefits set forth above which are associated with such a combination. The last preferably has an increased ball girth, for example, about three-sixteenths of an inch for a men's 8D shoe, which allows for the added volume of the custom sock in this embodiment.

The last according to the present invention provides a form for constructing a shoe that has sufficient shape, girth or volume, length, and width in the sole and shoe upper which effectively enables the wearer of a custom-shaped sock to enjoy the benefits of the sock while wearing the shoe. Bunching of the custom-shaped sock is eliminated by shoes produced from this last. The last also has an increased ball girth which allows for the added value of the custom sock in this embodiment.

Because the last of the present invention can be graded utilizing accepted grading systems from the disclosed model, mass-produced shoes can be provided to produce shoes which effectively mate and fit the foot of the wearer having a custom-shaped sock positioned thereon.

BRIEF DESCRIPTION OF THE DRAWINGS

For a more complete understanding of this invention reference should now be had to the embodiments illustrated in greater detail in the accompanying drawings.

FIG. 15 is perspective view of a custom-shaped sock positioned on the foot of a wearer.

FIG. 16 is a side view of the custom-shaped sock of FIG. 15 positioned on the foot of the wearer.

FIG. 17 is a side view of the custom shaped sock of FIG. 15 positioned on the foot of a wearer positioned within a shoe constructed on the last according to the present invention.

DETAILED DESCRIPTION OF THE PREFERRED EMBODIMENTS

The present invention now will be described more fully hereinafter with reference to the accompanying drawings, in which preferred embodiments of the invention are shown. The invention may, however, be embodied in many different forms and should not be construed as limited to the embodiments set forth herein, rather, these embodiments are provided so that this disclosure will be thorough and complete, and will fully convey the scope of the invention to those skilled in the art. Like numbers refer to like elements throughout.

Figure 1:
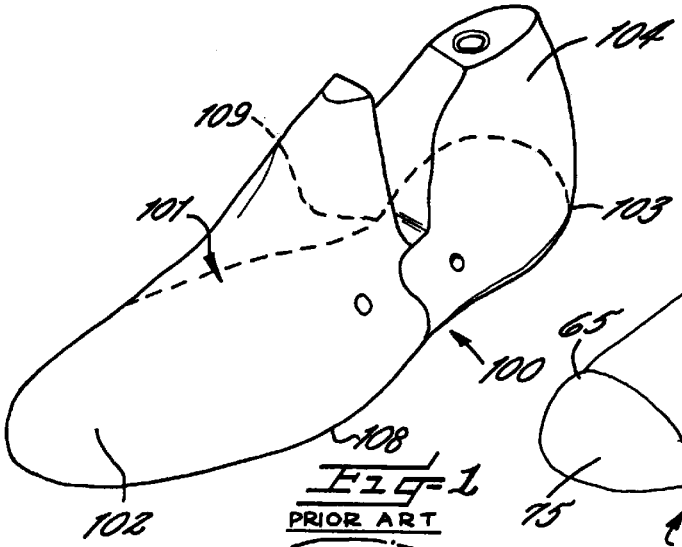
Fig-1 PRIOR ART
FIG. 1 is a side view in perspective of a prior art traditional last.

As set forth above, traditional shoe lasts are configured as a form to construct a shoe designed to fit the shape of an average human foot. For purposes of comparison to the last according to the present invention, a traditional last 100 is illustrated in FIG. 1. The traditional last 100 has a body 101 including a forepart 102 and a backpart 103. Each of the forepart 102 and the backpart 103 have a last bottom 108 and a last upper 104. The last bottom 108 includes an arch or shank portion 109 located between and partially extending into the forepart 102 and the backpart 103.

Contrary to the traditional last 100 shown in FIG. 1, FIGS. 2, 3, and 8–14 illustrate one embodiment of a last 40 according to the present invention. The last 40 is used in constructing a shoe 150 having a sole 151 and a shoe upper 152. The sole 151 has a custom-contoured shape for abuttingly contacting and matingly interfacing with a custom-shaped sock 120 positioned on a human foot FF. The last 40 is provided having a shape corresponding to or mimicking the shape of the custom-shaped sock 120 positioned on the foot FF of a wearer. As is readily understood by those skilled in the art to which this invention relates, the shoe last 40 may incorporate or blend all or some of the bulging portions into a smooth or continuous last similar in external appearance to the traditional last shown in FIG. 1. However, for purposes of illustration, the last 40 shown in FIGS. 2, 3, and 8–14 has bulging portions which have not been blended into the last to create a smooth transition as will appear in the preferred embodiment of the invention. In an alternative embodiment of the device, it is desirable to not blend some or all of the bulging portions but retain the last in the manner shown in FIG. 2.

FIGS. 15–16 illustrate one embodiment of a custom-shaped sock 120 positioned on the foot FF of a wearer to be utilized with the shoe 150 constructed on the last 40 according to the present invention. The custom-shaped sock 120 has thickened fabric areas in a heel portion 121, a ball portion 122, and a toe portion 123 of a lower end 124. Thickened fabric areas are also formed in side peripheries 125, 126, of an upper heel portion 127, and an upper toe portions 146 of a sock upper 129. The sock 120 also has thinner fabric portions in an arch portion 130. A sock such as the sock 120 illustrated in FIGS. 15–16 can be seen in the Throneburg '517 patent which is incorporated by reference herein in its entirety as mentioned previously. The sock illustrated in FIGS. 15–16 is only for purposes of an example. It is to be understood that the last according to the present invention can be configured to correspond to or mimic the shape of other custom-shaped socks having various thickened fabric areas, thinner fabric areas or other custom-shaping. The shoe last 40 and shoe 150 would accordingly be modified to accommodate a different custom-shaped sock.

FIGS. 3–7 illustrate an embodiment of the shoe 150 constructed on the last 40 to be used with the custom-shaped sock 120. The shoe 150 includes a sole 151 which has a custom-contoured shape configured to matingly interface and abuttingly contact adjacent thickened fabric areas and thinner fabric areas of the custom-shaped sock 120 described herein.

Various portions of the sole 151 are configured to receive, abuttingly contact, and matingly interface with overlying portions of the custom-shaped sock 120. The lengthwise extent of each portion of the sole 151 corresponds substantially to i.e., is substantially proportional to the lengthwise extent of the respective lower overlying portions of the custom-shaped sock 120 when positioned thereon. This interrelationship between the custom-shaped sock and the sole is shown best in FIG. 17.

The shoe upper 152 conforms to the shape of the upper portion 41 of the last 40 so as to correspond to the thickened knit fabric areas of side portions 131, the upper heel portion 127, and the toe portion 123 of the custom-shaped sock 120 when positioned on the foot FF of a wearer positioned therein. This shape of the shoe upper 152 allows the shoe 150 to more comfortably receive the custom-shaped sock 120 having thickened fabric areas.

The custom-contoured shoe 150 enables the wearer to experience the benefits and advantages of the custom-shaped sock 120 free of bunching and other problems associated with wearing the custom-shaped sock 120 with a shoe constructed on a traditional last 100. The resultant shoe and footwear system may be seen in FIGS. 3–14 and FIG. 17–24. Other embodiments of the footwear system are disclosed in U.S. patent applications Serial No. 08/097,086, filed Jul. 23, 1993; Ser. No. 08/601,702, filed Feb. 15, 1996; Ser. No. 08/216,264, filed Mar. 21, 1994; and Ser. No. 08/467,820, filed Jun. 6, 1995 to common assignee Throneburg et al., which are incorporated by reference herein.

FIGS. 3–7 show one embodiment of the sole 151 having a recessed heel portion 154 and recessed ball portion 155 for matingly interfacing and abuttingly contacting the overlying thickened fabric heel and ball portions 121, 122 of the sock 120. These sole heel and ball portions 154, 155 have a depth of a predetermined distance below the plane of the shank portion 156 proportionally corresponding to the downwardly extending thickness of the overlying thickened fabric areas of the heel and ball portions 121, 122 of the custom-shaped sock 120.

Figure 3:
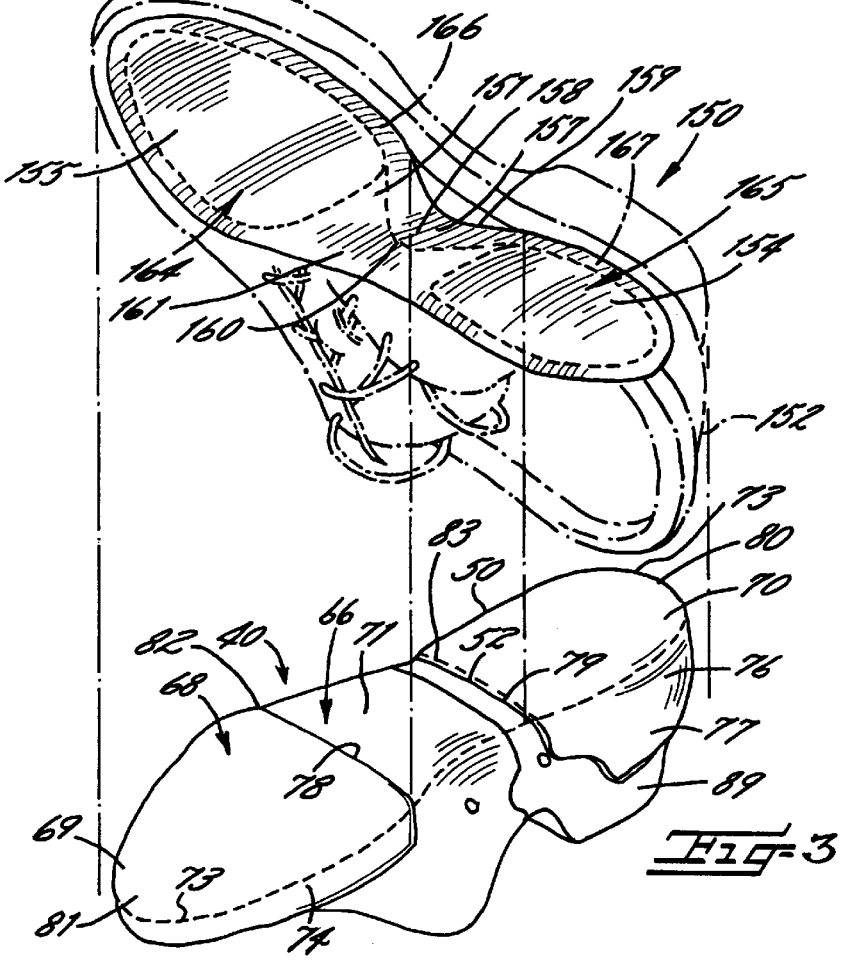
FIG. 3 is an exploded view of a shoe constructed on the last shown in FIG. 2 and the last.

As shown in FIGS. 3 through 7, the sole 151 also has a raised arch portion 157 including a hump 158 for providing comfort and support to the arch of the foot FF of the wearer. The raised arch portion 157 with hump 158 is arranged to receive the overlying thinner fabric arch portion 130 of the sock 120 when positioned thereon. The hump 158 includes medial and lateral peripheries 159, 160 and a substantially flat plateau 161 which extends outwardly from around the lateral periphery 160. Also, the raised arch portion 157 includes oppositely inclined fore and aft portions 162, 163 which are adjacent the plateau portion 161 and are included in the hump 158 for providing a smooth transition with the ball portion 164 and major areas of the heel portion 165 of the sole 151. As seen in FIG. 3, the raised arch portion 157 of the sole 151 is arranged to have a greater upward extent towards an overlying custom-shaped sock 120 than either the ball portion 164 or the major areas of the heel portion 165 of the sole 151.

The shoe upper 152 when formed on the last 40 also has side peripheries 166, 167, upper heel portions 168, and toe portions 169 which conform to the shape of the bulging areas of the last 40, so as to matingly interface with adjacent thickened fabric portions in the side peripheries 125, 126, the upper heel portion 127, and the upper toe portion 128 of the sock 130.

An alternative embodiment of the shoe 150' can be seen in FIGS. 17–26. The shoe 150' of the embodiment of FIGS. 17–26 includes a sole 151', shown and shoe upper 152' having custom-contoured shapes configured to matingly interface and abuttingly contact adjacent thickened fabric areas and thinner fabric areas of the custom-shaped sock 120 as described herein. The shoe 150' has the substantially the same components as the shoe 150 described herein except the sole 151' has a raised arch portion 157' without a hump. The discussion of the previously described embodiment is therefore incorporated by reference herein. The sole 151', includes a recessed ball portion 155' and a recessed heel portion 154', as previously described, for matingly interfacing and abuttingly contacting the overlying thickened fabric heel and ball portions 121, 122 of the sock 120. The shoe upper 152' also includes side peripheries 166', 167', upper heel portions 168', and toe portions 169' having corresponding areas which matingly interface with adjacent thickened fabric portions in the side peripheries 125, 126, the upper heel portion 127, and upper toe portion 128 of the sock 130.

FIGS. 2–14 illustrate one embodiment of the last 40 according to the present invention, which is used in constructing the custom-contoured shoe 150 having the sole 151 and the shoe upper 152 configured to matingly interface with and abuttingly contact the custom-shaped sock 130. The last 40 has a body 41 having a shape corresponding to the shape of the particular custom-shaped sock 120 positioned on the foot FF of a wearer.

For purposes of illustration, the last 40 according to the present embodiment is used to construct a men's walking shoe and will be described herein as such. However, it is to be understood that the last 40 according to the present invention can be utilized to form or construct shoes of various styles. including, but not limited to, work shoes and boots, dress shoes, athletic shoes, and walking shoes. Further, the last according to the present invention can be utilized to construct shoes for a variety of age and gender combinations including shoes for adults, children, toddlers, infants, men, women, boys, and girls.

For purposes of discussion, the last 40 according to the present invention can be defined with reference to various standard lines, planes, and dimensions. The standard lines, planes, and dimensions are known to those skilled in the art through publications such as "Speaking of Lasts: A Compilation of Last Terms," American Footwear Manufacturers Association (1970). The definitions therein are incorporated herein by reference.

Figures 13, 14:
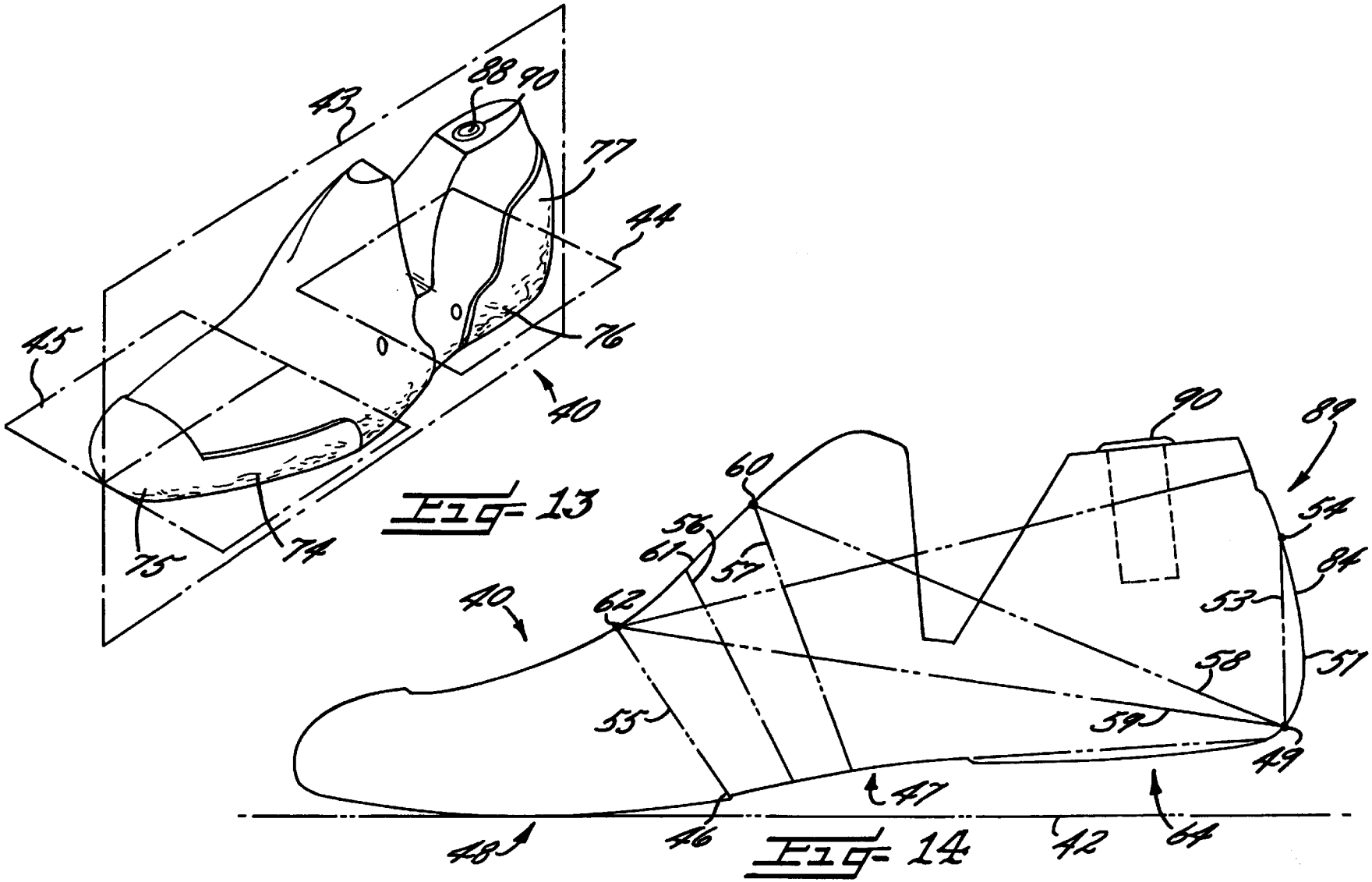
FIG. 13 is a side view in perspective of the last according to the present invention showing planes of the last.
FIG. 14 is a side view of the last according to the present invention showing various measurement points and dimensions.
Figure 18:
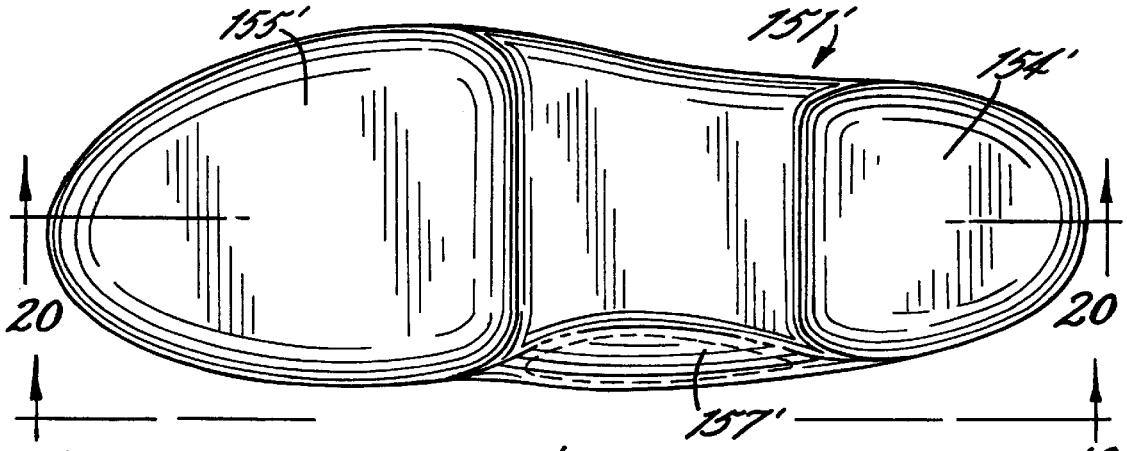
FIG. 18 is top view of a sole for a shoe constructed on the last.
Figure 19:
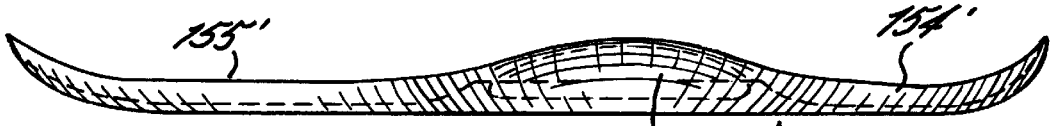
FIG. 19 is a side view taken along line 19—19 of FIG. 18 of the sole.
Figure 20:
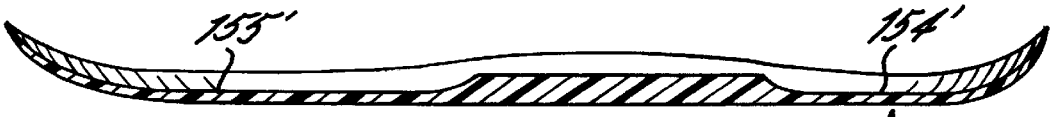
FIG. 20 is a section view taken along line 20—20 of FIG. 18 of the sole.
Figure 21:
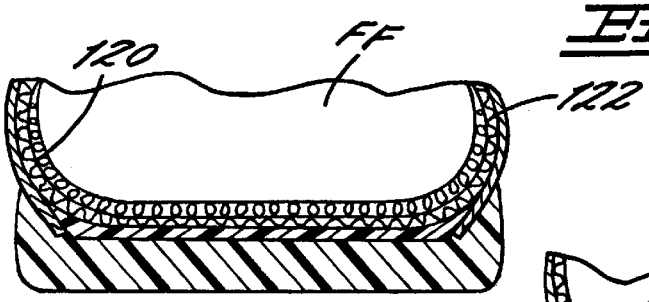
FIG. 21 is a section view taken along line 21—21 of FIG. 17 of the shoe constructed on the last having a foot wearing a custom-shaped sock positioned therein.
Figure 22:
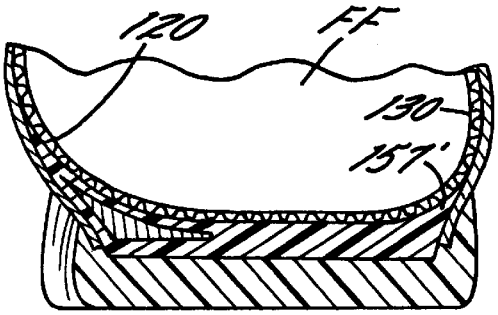
FIG. 22 is a section view taken along line 22—22 of FIG. 17 of the shoe constructed on the last having a foot wearing a custom-shaped sock positioned therein.
Figure 23:
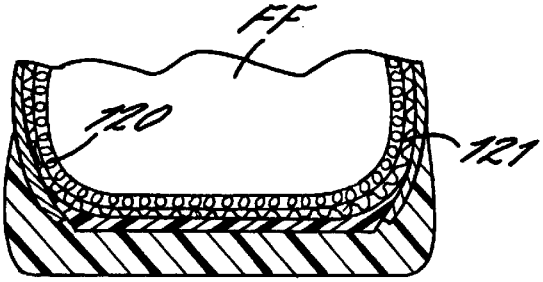
FIG. 23 is a section view taken along line 23—23 of FIG. 17 of the shoe constructed on the last having a foot wearing a custom-shaped sock positioned therein.

These standards are applied to the last 40 illustrated in FIGS. 13 and 14. As shown, the body 41 can be defined in reference to a base plane 42 which forms the primary horizontal attitude of the body. A last centerline plane 43 extends generally perpendicular to the base plane 42. A heel featherline plane 44 extends generally perpendicular to the last centerline plane 43. A forepart featherline plane 45 extends generally perpendicular to the last centerline plane 43.

The last 40 can also be defined with reference to various measurement points and dimensions. The last ball break 46 is located at a proximal end of the shank portion 47, tangent to a plane passing through the heel point 49, and perpendicular to the last centerline plane 43. The last 40 has a heel featherline 50 which is a line that defines the heel seat shape or bottom surface of the heel end portion 51 of the last 40 from the breast line 52 rearward toward the distal end portion. The heel featherline plane 44 is the plane of the heel featherline 50. The body 41 also includes a heel curve base line 53 defined by a line drawn between a heel point 49 and a backseam tackpoint 54. The heel curve base line 53 is perpendicular to a portion of the last centerline plane 43.

As shown in FIG. 14, various dimensions of the last 40 can be measured using traditional last measuring points. Included in these dimensions are the ball girth 55, waist girth 56, instep girth 57, short heel girth 58 and long heel girth 59.

Figure 2:
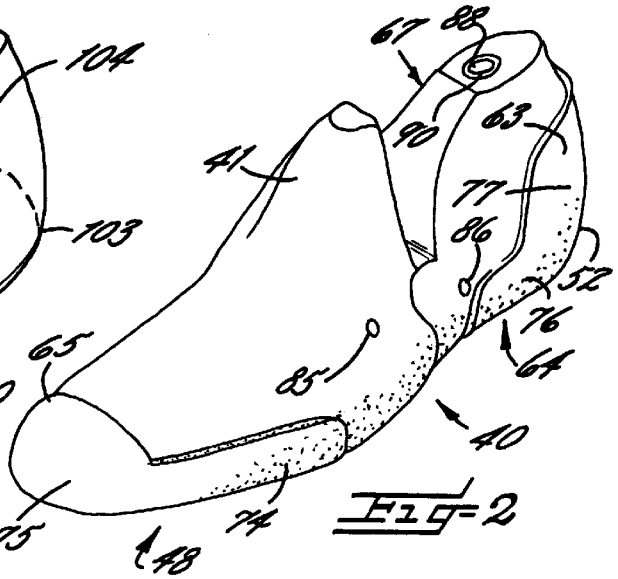
FIG. 2 is a side view in perspective of a last according to the present invention.

Referring now to FIGS. 2–14, the shoe last 40 includes a body 41 having a backpart 64 and a forepart 48 connected to the backpart 64 and extending forwardly therefrom. As shown in FIGS. 2 and 14, the backpart 64 is that portion of the last 40 which extends rearward from a ball break 46 of the last 40 to a distal back of a heel portion 63. The forepart 48 is the portion of the last 40 extending from the ball break 46 to a proximal front or toe portion 65 of the last 40. Each of the forepart 48 and the backpart 64 includes a last bottom portion 66 and a last upper portion 67.

The last bottom portion 66 is defined by the lower peripheries of the forepart 48 and backpart 64. The last bottom portion 66 includes a ball interface bulging portion 68, a toe interface portion 69 in the forepart 48, a heel interface bulging portion 70 in the backpart, and a recessed arch shank interface portion 71 located between and partially extending into the backpart 64 and the forepart 48. The toe interface portion 69 extends from the proximal end portion of the last bottom portion 66 rearward along the last bottom portion 66 and is connected to the proximal end portion of the ball interface bulging portion 68. The ball interface bulging portion 68 extends rearwardly along the last bottom portion 66 to the proximal end of the recessed arch shank interface portion 71. The recessed arch shank interface portion 71 extends rearwardly therefrom, and is connected to a proximal end of the heel interface bulging portion 70. The heel interface bulging portion 70 extends rearwardly to the distal end of the last bottom portion 66.

The last bottom portion 66 includes a last bottom featherline 73 which defines the outer bottom shape or periphery of the shoe last 40. The bottom shape of the shoe last 40 mimics or corresponds to the bottom shape of the custom-shaped sock 120, as shown in FIGS. 15–16.

The components of the bottom shape of the shoe last 40 are also configured to abuttingly contact and matingly interface with the sole 151 described herein when the sole 151 is placed on the last bottom portion 66 while forming the shoe 150 on the last 40. For example, the ball interface bulging portion 68 and the heel interface bulging portion 70 respectively abuttingly contact and matingly interface with the recessed ball and heel portions 154, 155 of the sole 151. The recessed arch shank interface portion 71 matingly interfaces with the raised arch portion 157 and the hump 158 of the sole 151 when a shoe 151 is formed on the last 40.

The upper portion 67 of the last 40 includes a toe upper portion 75 and side interface bulging portions 74 in the forepart 48, and backpart side interface bulging portions 76 and an upper heel. interface bulging portion 77 in the backpart 64. The toe upper portion 75 extends rearwardly from the proximal end of the last upper portion 67 and is connected with the side interface bulging portions 74 extending rearwardly from distal portions of the toe upper portion 75 along opposite side peripheries of the last upper portion 67. The upper heel interface bulging portion 77 extends from the distal end of the last upper portion 67 forwardly along the heel periphery of the last upper portion 67. The backpart side interface bulging portions 76 are connected with proximal end portions of the upper heel interface bulging portions 77 and extend forwardly along opposite side peripheries of the last upper portion 67. The shape of the last upper portion 67 mimics and corresponds to the shape of the upper portion of the custom-shaped sock 120. The bulging portions of the last upper portion 67, including the side interface bulging portions 74, the toe upper portions 75, the backpart side interface bulging portions 76, and the upper heel interface bulging portions 77 respectively abuttingly contact and matingly interface with respective portions of the shoe upper 152 formed on the last 40.

As mentioned, these bulging portions, including the ball interface bulging portion 68, the toe interface portion 69, the heel interface bulging portion 70, the side interface bulging portions 74, the toe upper portion 75, the backpart side interface bulging portions 76, and the upper heel interface bulging portions 77 are configured to mimic or correspond to thickened fabric portions in the custom-shaped sock 120 when positioned on the foot FF of a wearer as described herein. The recessed arch shank interface portion 71 is configured to correspond to the thinner fabric area in the arch portion 130 of the overlying sock 120 as shown in FIG. 16. These various bulging portions and recessed arch shank interface portion 71 can be varied accordingly to provide different dimensions and can be placed in different positions on the last 40 depending on the shape of the custom-contoured sock 120 when positioned on the foot FF of a wearer.

Further, the bulging portions have thicknesses proportionally corresponding to the thicknesses of the thickened fabric areas of the custom-shaped sock 120. As illustrated in FIGS. 3, 8, 10 and 11, the ball interface bulging portion 68, the heel interface bulging portion 70, and the toe interface bulging portion 69 each extend downwardly a predetermined distance proportionally corresponding to the thickness of thickened fabric areas in respective toe, ball, and heel portions 123, 122, 121 of the custom-shaped sock 120. Specifically, the ball interface bulging portion 68 and the toe interface portions 69 extend downwardly from the forepart featherline plane 45 toward the base plane 42 a predetermined distance. This predetermined distance can be varied as desired. The distance of one-eighth of an inch is shown in the embodiment in FIGS. 3, 14. The heel interface bulging portion 70 extends downwardly from the heel featherline plane 44 towards the base plane 42 a predetermined distance. This predetermined distance likewise is also variable as desired. The distance of about one-eighth of an inch is shown in the embodiment of FIGS. 3, 14.

The heel interface bulging portion 70, the toe interface portion 69, and the ball interface bulging portion 68 extend these predetermined distances corresponding to the downwardly extending thickened cushion area of a sock 120 having thickened fabric areas in the heel, toe, and ball portions 121, 123, 122. In this embodiment of the last 40, the heel and ball interface bulging portions 70, 68 protrude outwardly throughout respective substantial extents thereof. Various other configurations of the ball interface bulging portion 68 and the heel interface bulging portion 70, and other bulging portions, can be provided in alternative embodiments of the last 40 to correspond to the shape of various shapes and thicknesses of a custom-shaped sock positioned on the foot of a wearer.

Figure 4:
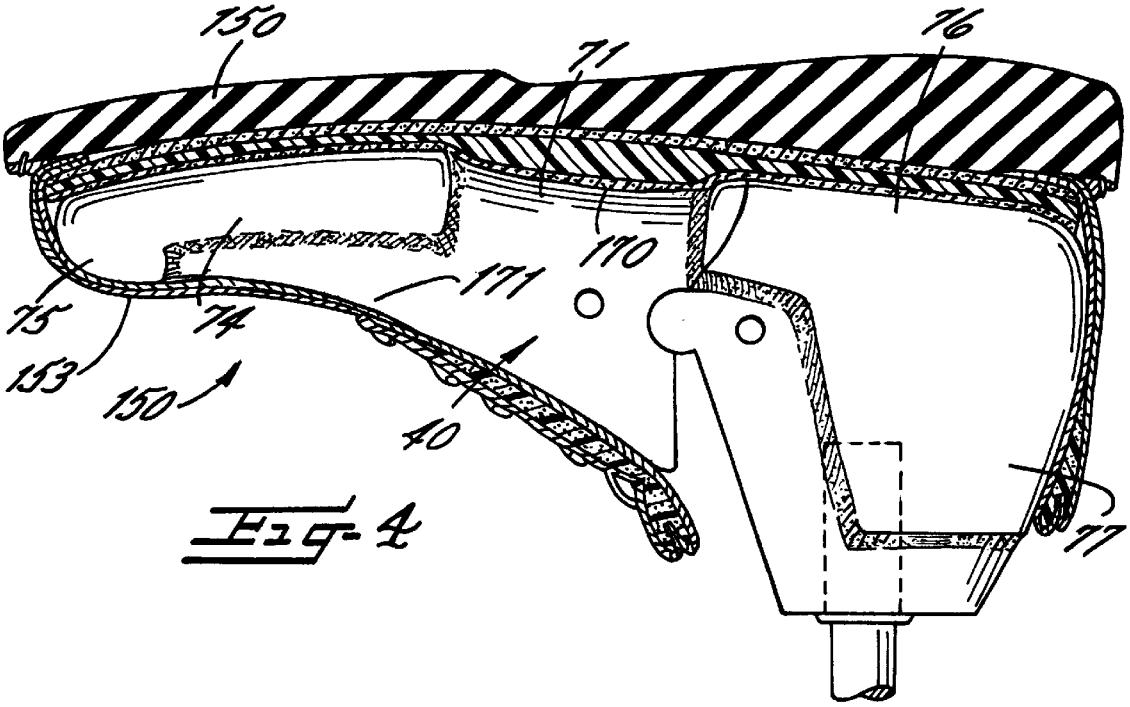
FIG. 4 is a side view, partially in cross section, of the last shown in FIG. 2 inserted in a shoe in cross section mounted thereon.
Figure 5:
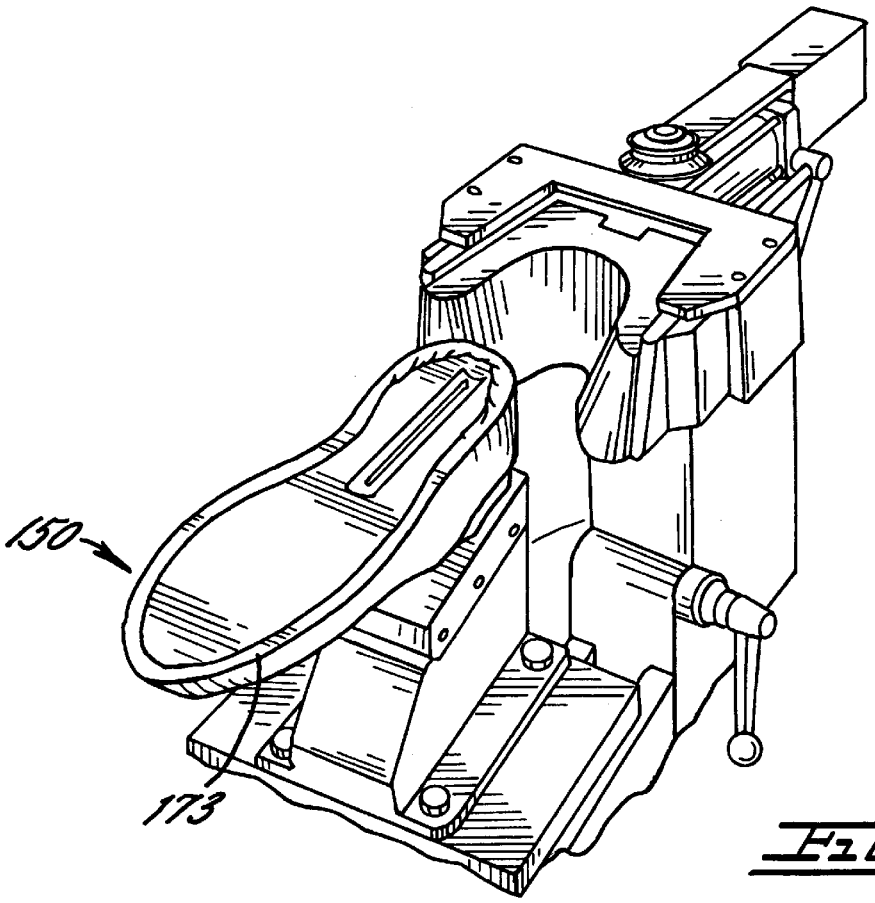
FIG. 5 is a side view in perspective of a last according to the present invention connected to a last jack stand machine and having a sole and shoe upper mounted on the last.

In the last 40 of FIGS. 2 and 3, the recessed arch shank interface portion 71 is spaced apart from the base plane 42 a predetermined distance corresponding to the downwardly extending ball interface bulging portion 68 and the heel interface bulging portion 70. This predetermined distance can be varied proportionally to the heel and ball bulging portions of the sock. In the embodiment as shown in FIGS. 3–4 and 14, the recessed arch shank interface portion 71 is about one-eighth of an inch. As shown in FIGS. 3 and 4, the recessed arch shank interface portion 71 is spaced apart from the lower end peripheries of the heel interface bulging portion 70 and the ball interface bulging portions 68 the predetermined distance described which is approximately one-eighth of an inch greater than the distance between an arch portion and lower peripheries of heel and last bottom of a traditional last for a corresponding shoe style size. The distance of separation in the last 40 corresponds to the extra thickness of fabric in the heel and ball portions 121, 122 of the custom-shaped sock 120 as compared to a conventional sock.

Further, the recessed arch shank interface portion 71 has major portions which are substantially flat. In the embodiment in FIGS. 3 and 4, the recessed arch shank interface portion 71 includes oppositely inclined fore portion 78 and aft portion 79 adjacent respective peripheries 80, 81 of the heel interface bulging portion 70 and the ball interface bulging portion 68. The last 40 also includes proximal portions of the heel interface bulging portion 70.and the ball interface bulging portion 68 which terminate in substantially straight lines 82, 83 with their respective junctures to the recessed arch shank interface portion 71. As seen in FIG. 3, the respective straight line junctures 82, 83 are substantially parallel to each other. These straight line junctures 82, 83 correspond to substantially parallel junctures 132, 133 of proximal portions of the heel and ball portions 121, 122 of a custom-shaped sock 120 illustrated in FIG. 16.

Figure 12:
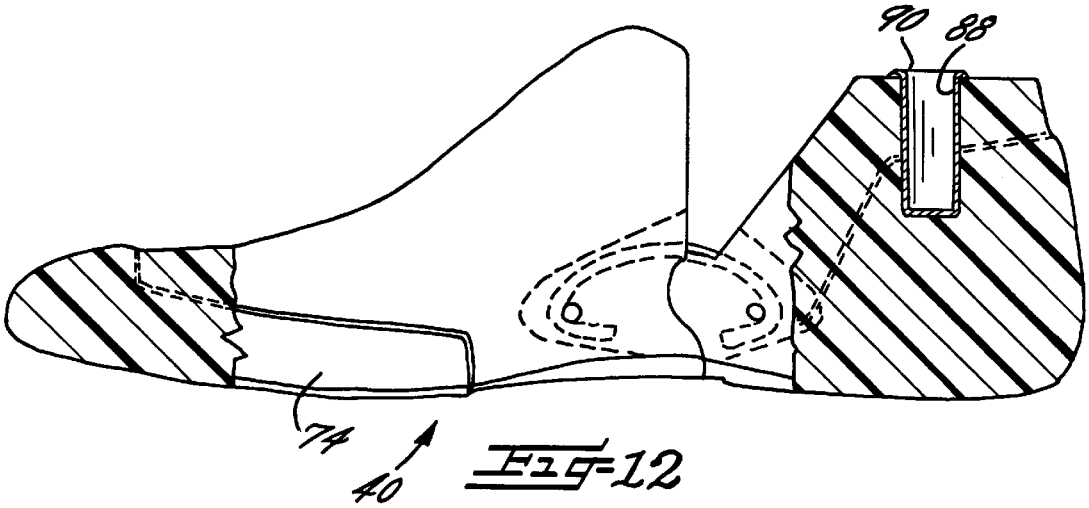
FIG. 12 is a section view of the last taken along line 12—12 of FIG. 9.

Referring to FIGS. 2–14, the side interface bulging portions 74, the backpart side interface bulging portions 76, the upper heel interfacing bulging portion 68, and the toe upper portion 75 are each provided in the last 40 for abuttingly contacting and interfacing with the side peripheries 166, 167 of the shoe upper 152. The side interface bulging portions 74 and the backpart side interface bulging portions 76 extend outwardly a predetermined distance from the last centerline plane 43. As illustrated in FIGS. 10 and 12, the side interface bulging portions 74, the backpart side interface bulging portions 76, the toe upper portion 75, and the upper heel interface bulging portion 68 each have a predetermined thickness corresponding to the laterally extending thickened cushioned areas 134 of the custom-shaped sock 120. The side interface bulging portion 74 and the backpart side interface bulging portion 76 extend a predetermined distance greater than the respective side portions of a traditional last 100 for a corresponding shoe style size.

Figure 9:
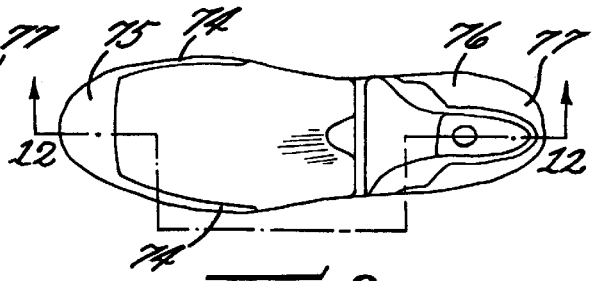
FIG. 9 is a top view of the last shown in FIG. 8 illustrating the bulging portions of the side and toe portions.
Figure 10:
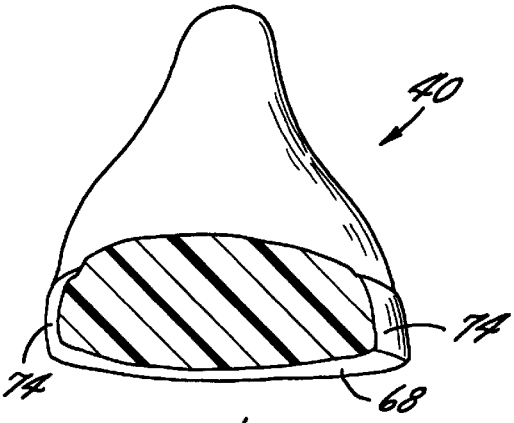
FIG. 10 is a section view of the last taken along line 10—10 of FIG. 8 showing the side interface bulging portions.
Figure 11:
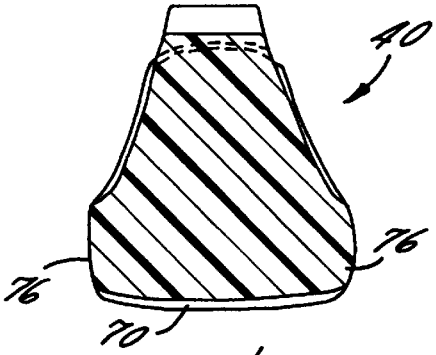
FIG. 11 is a section view of the last taken along line 11—11 of FIG. 8 showing the upper heel interface bulging portions.

Similarly as shown in FIGS. 9 and 12, the upper heel interface bulging portion 68 extends along the upper heel portions 63 of the backpart 64. The upper heel interface bulging portion 68 protrudes outwardly along the heel curve 84 of the backpart upper portion 89 and extends a predetermined distance from the heel curve base line 53. The upper heel interface bulging portion 68 also has a predetermined thickness corresponding to the laterally extending thickened cushioned areas of the upper heel portion 127 of the custom-shaped sock 120.

In the last 40 illustrated in FIGS. 2–14, the side interface bulging portions 74 and the ball interface bulging portion 68 of the forepart 48 increase the ball girth 55 of the last 40 as compared to the ball girth of a traditional last for a corresponding shoe style size. This increase in the predetermined ball girth 55 corresponds to the thickened ball girth of a human foot of a corresponding size having a custom-shaped sock 120 having thickened fabric cushioned areas formed in the ball portion 122 and upper portion 129 as described herein. The last 40 as shown in FIGS. 2–14, has a predetermined ball girth circumference which is increased, preferably about 3/16 of an inch, as compared to the ball girth of a traditional shoe last for a corresponding shoe style size. This ball girth circumference may vary to proportionally correspond to the size of the custom-shaped sock.

Traditional lasts include "generally accepted ball girths" for men's, women's, and children's lasts, as explained by the Adrian text, and are incorporated by reference herein. For Example, a men's 8D traditional last has a generally accepted ball girth of about 9¼ inches according to Adrian p. 54, while the last 40 for a men's 8D would have a ball girth of about 9 7/16 inches. Like variation could be expected throughout various sizes and styles. As explained, the last 40 can, alternatively, be provided with increased or decreased portions to proportionally correspond with different sock configurations, thereby increasing or decreasing the last at various dimensions such as ball girth, waist girth, instep girth, long heel girth, short heel girths, length, width, and/or other points of measurement.

The various bulging portions, including the toe interface portion 69, the backpart side interface bulging portions 76, the forepart side interface bulging portions 74, and the heel interface bulging portions 70 also provide added volume in a shoe 150 constructed therefrom to assist a wearer in inserting a foot FF having a custom-shaped sock 120 with thickened fabric areas therein. Thus, the last 40 preferably has an overall shape generally corresponding to the overall shape of the custom-shaped sock 120 when placed on the foot FF of the wearer.

As shown in the embodiment the last 40 of FIGS. 9 and 12, the shoe last 40 according to the present invention includes a standard "V" hinge. Two hinge pin holes are drilled into respective adjacent portions of the forepart 48 and the backpart 64. Two hinge pins 85 and 86 are inserted in respective adjacent hinge pin holes. A hinge 92 is connected between the two pins 85, 86 in a hinge slot 87. Alternatively, other types of hinged lasts such as standard two-pin type lasts and other non-hinged lasts can be utilized with the shoe last 40 according to the present invention.

Figure 6:
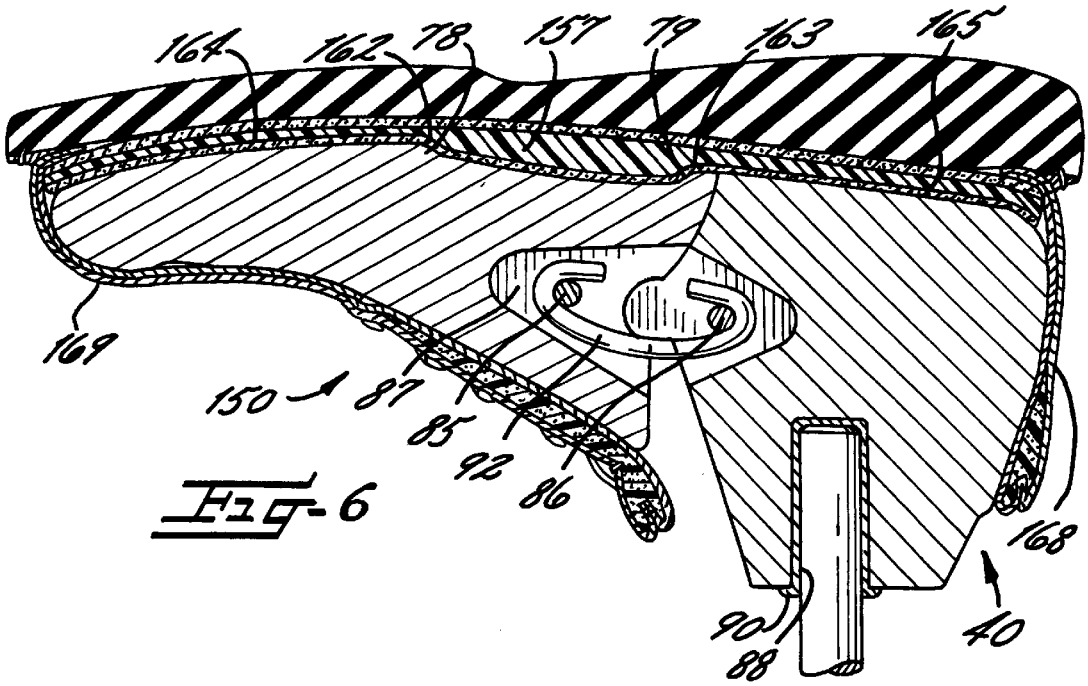
FIG. 6 is a view similar to that shown in FIG. 4, illustrating a hinged last according to the present invention.
Figure 7:
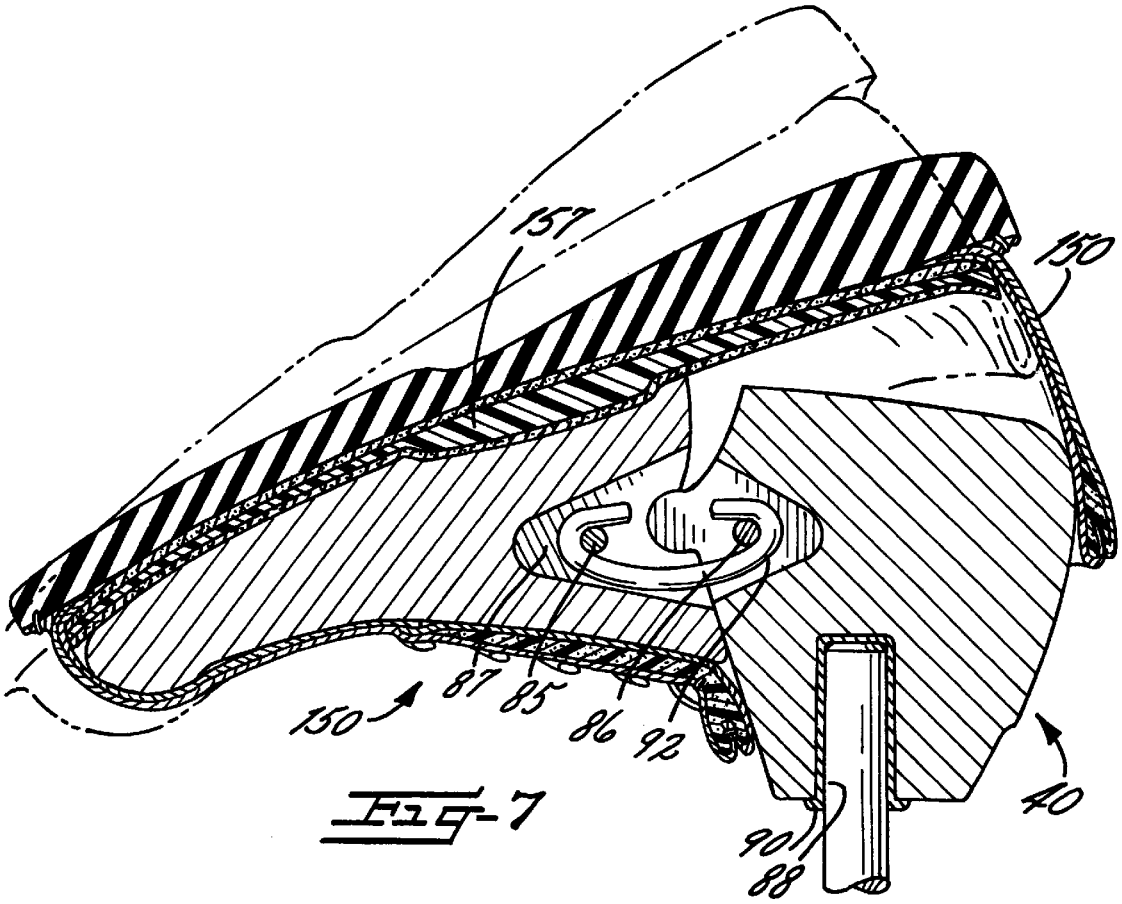
FIG. 7 is a side view of a hinged last pivoting within a shoe constructed around the last.
Figure 8:
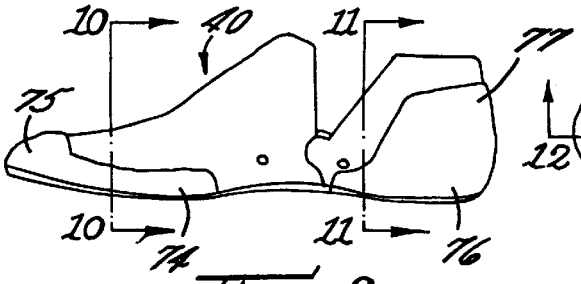
FIG. 8 is a side view of the last shown in FIG. 2.

In the embodiment of the last 40 illustrated in FIGS. 4–7, the backpart 64 and the forepart 48 of the last 40 pivot relative to one another about the hinge 92. The shoe last 40 also includes a thimble hole 88 extending vertically downwardly a predetermined distance from the top portion of the backpart upper portion 89 toward the lower end portion 66. FIGS. 6 and 7 illustrate a shoe last 40 having a thimble 90 inserted into the thimble hole 88 during shoe construction. The shoe last 40, alternatively, can be provided with various other configurations of securing the last during shoe making including a ferrule hole to receive a ferrule (not shown) or a combination ferrule hole and thimble hole or other configurations known to one of ordinary skill in the art.

Another alternative embodiment of the last 40' according to the present invention is shown in FIGS. 18–26. The last 40' includes a body 41' having a backpart 64' and a forepart 48' as described in reference to the embodiment of the last 40. The last 40' includes a last bottom portion 66' having a ball interface bulging portion 68', toe interface portion 69', heel interface bulging portion 70', and a last upper portion 67' having a toe upper portion 75', side interface bulging portions 74', backpart side interface bulging portions 76', and upper heel interface bulging portions 77', all substantially similar to the last 40 and respective components described herein. The previous discussion of these components of last 40 is, hereby, incorporated by reference.

Figure 24:
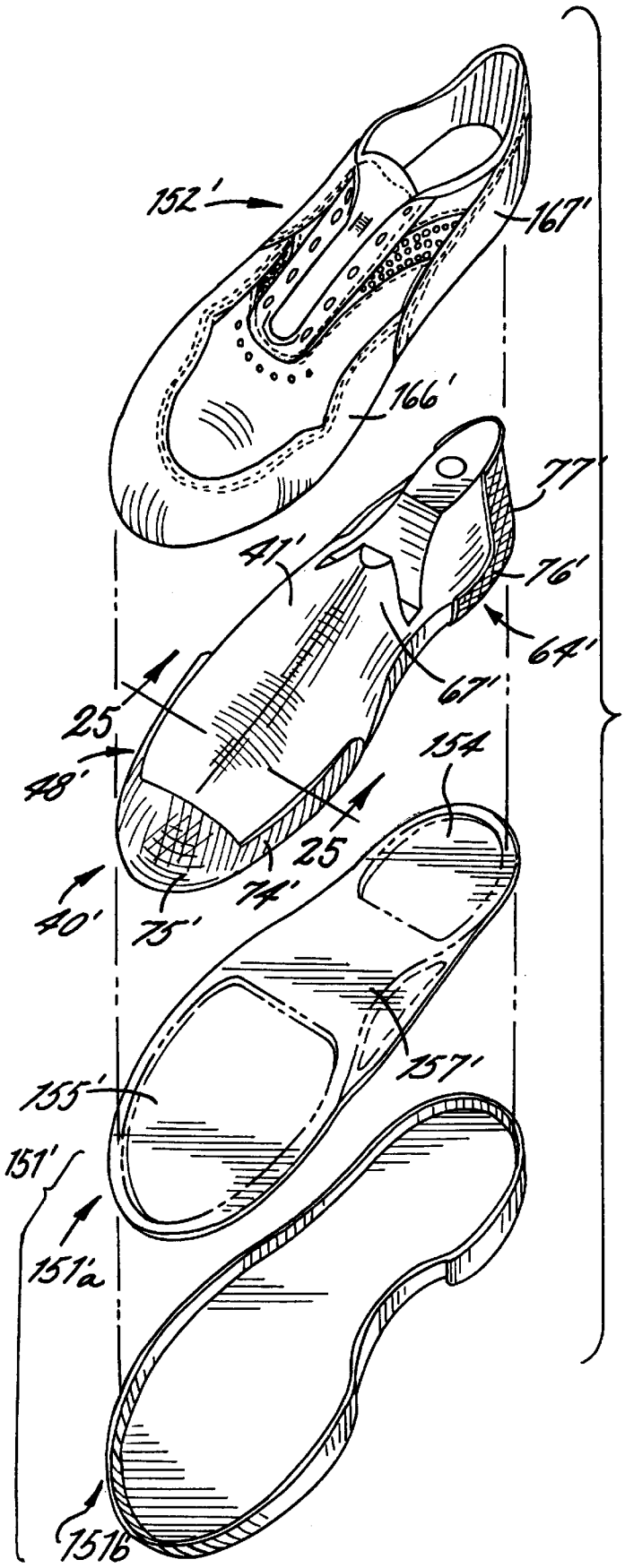
FIG. 24 is view in perspective of the last according to the present invention with an exploded view of shoe constructed on the last.

The last 40', however, includes a recessed arch shank interface portion 71' in the lower end 66' which is configured to matingly interface and abuttingly contact the sole 151' having the raised arch portion 157' without a hump. As such, the recessed arch interface portion 71' is not recessed or spaced apart a distance from the base plane 46 in the portion of the recessed arch shank interface portion 71' which overlies the raised arch portion 157' of the sole 151' as great as the distance the recessed arch shank interface portion 71 is spaced apart from the base plane 46 in last 40. As shown in FIG. 24, sole 151' includes an innersole **151*a*' and an outersole 151*b*'**.

Various methods of constructing a shoe using the last 40 according to the present invention are provided. Referring to FIGS. 3–7, one embodiment of a method of constructing a shoe according to the present invention is disclosed. The shoe 150 is particularly constructed to be worn with and matingly interface with a worn custom-shaped sock 120.

A specially designed sole 151 and various shoe components including an outersole, a midsole, and a welt are also provided. Having provided the specially configured last 40 and components, the last 40 is positioned in an inverted position in a last jack stand machine shown in FIGS. 4 and 5.

The upper surface 170 of a sole 151, as described having a shape corresponding to the bottom shape of a worn custom-shaped sock, is positioned so as to abuttingly contact and matingly interface with the last bottom portion 66 of the shoe last 40. The sole 151 is positioned on the shoe last 40 such that the lower periphery of the inner surface 171 of the shoe upper 152 abuttingly contacts a side periphery of a lower surface 172 of the sole 151. The shoe upper 152 has medial portions of the inner surface 171 abuttingly contacting and mating with the side bulging interface portions 74 of the last. In this method a shoe upper 152 is provided having recessed portions 153 to comfortably receive and matingly interface with thickened fabric areas of a custom shaped sock 120. Thus, having positioned the specially shaped sole 151 and the shoe upper 152, a shoe 150 is formed having a shape which abuttingly contacts and matingly interfaces with the shape of the last body 41 along the last bottom portion 66 and last upper portion 67. In other words, the shoe upper 152 is positioned on the specially constructed last 40 so that the shoe 150 is formed having a shoe upper 152 having a shape corresponding to side peripheries of the custom-shaped sock 120 when positioned on the foot FF of a wearer.

This embodiment of the method can also include the step of positioning a lower periphery of the inner surface 171 of the shoe upper 152 such as to abuttingly contact a side periphery 173 of a lower surface 172 of the sole 151. The shoe upper 152 would also have medial portions of the inner surface 171 abuttingly contacting and mating with portions of the shoe last upper portion 67. Again, this would provide a shoe upper 152 having a shape corresponding to side periphery portions 125, 126 of a custom-shaped sock 120 when positioned on the foot FF of a wearer.

Figure 25:
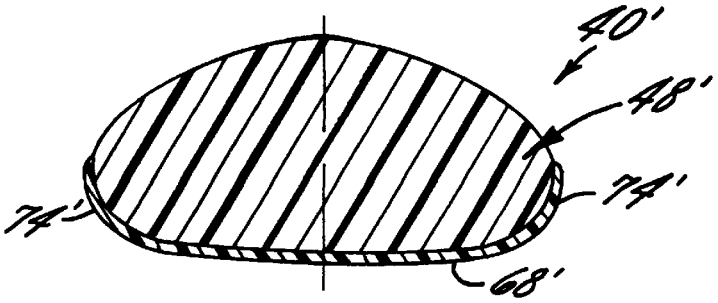
FIG. 25 is a section view taken along line 25—25 of FIG. 24 of the last.
Figure 26:
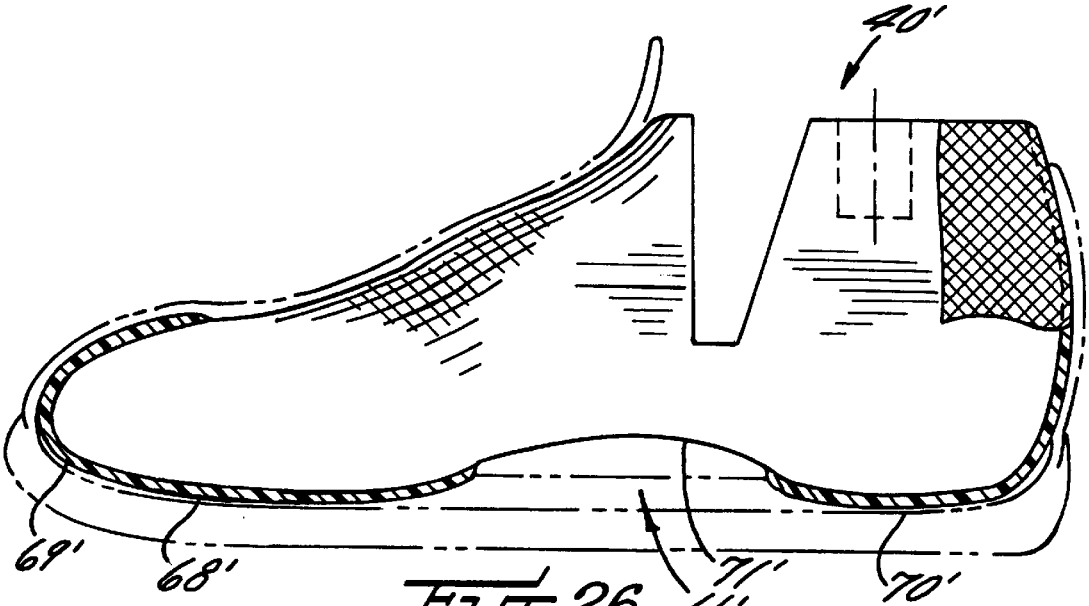
FIG. 26 is a side view in partial cross section of the last according to the present invention within a shoe constructed on the last.

FIG. 24–26 shows the components of the alternative embodiment of the shoe 150' constructed according to the method of constructing a shoe utilizing last 40'. FIG. 24 illustrates components included in this method such as the shoe upper 152', the last 40', the sole 151', including the innersole 151*a*' and the outersole 151*b*', being placed together to form shoe 150' shown in FIG. 17. Conventional shoe making steps such as providing a welt are then accomplished to complete construction of a shoe. The shoe would then be constructed with known methods of fastening the components together thorough cementing or stitching utilizing known forms of shoe construction. In the embodiments of the method of constructing a shoe uutilizing the last 40 and last 40' according to the present invention as seen in FIGS. 4–7 and 24–26, general additional steps are utilized in addition to the steps explained. These extra steps are well known to one of ordinary skill in the art.

Upon completion of construction of the shoe 150, the hinged last 40 enables the last to be removed from the shoe as seen in FIGS. 6 and 7 with the backpart 64 pivoting downwardly relative to the forepart 48 and being removed from the shoe 150.

Figure 27:
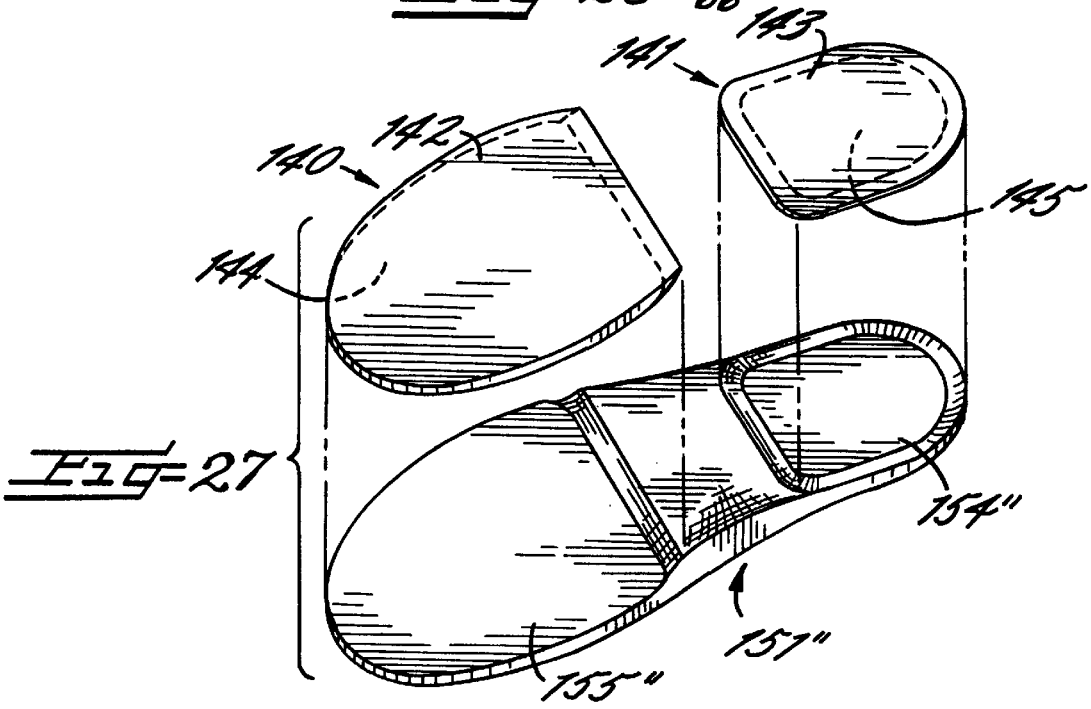
FIG. 27 is an exploded view of a sole configured to be utilized in a shoe with a custom-shaped sock and levelers for use in constructing the shoe.
Figure 28:
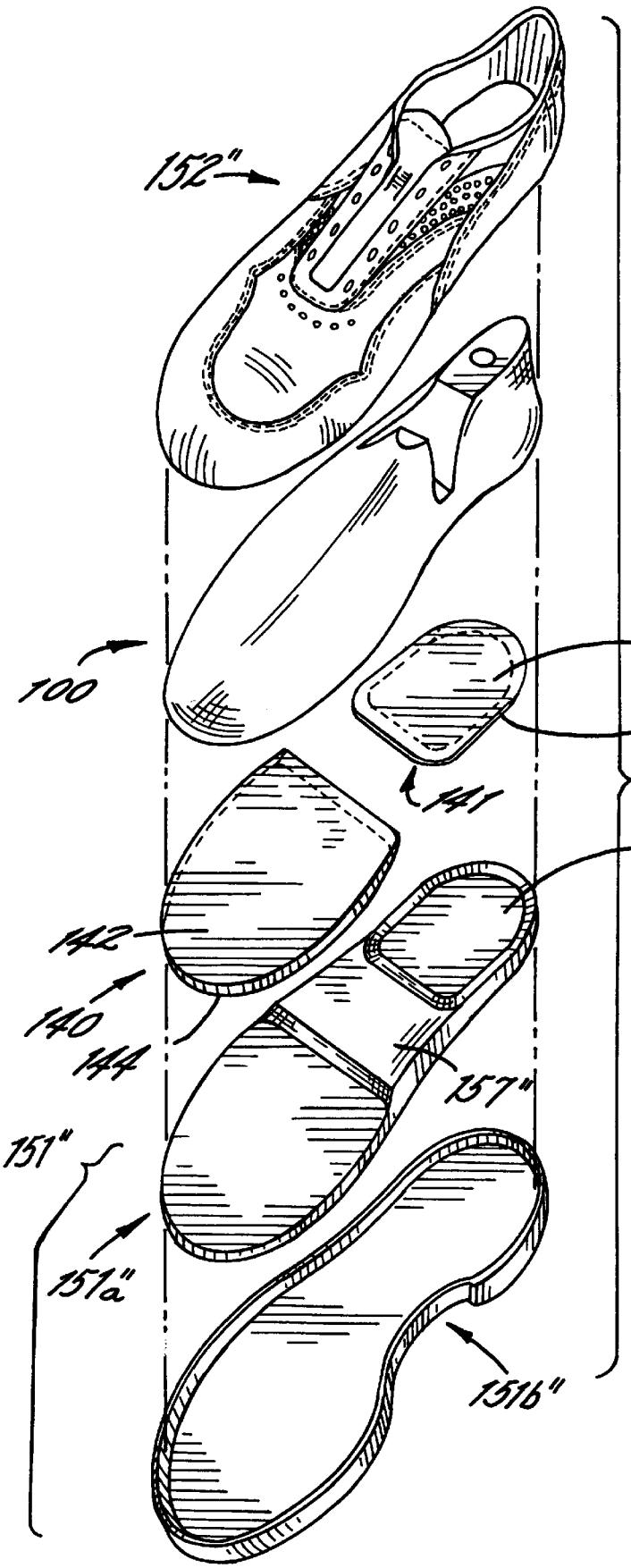
FIG. 28 is an exploded view of an alternative embodiment of a last and levelers for use in constructing a shoe having a shoe upper and a sole.
Figure 29:
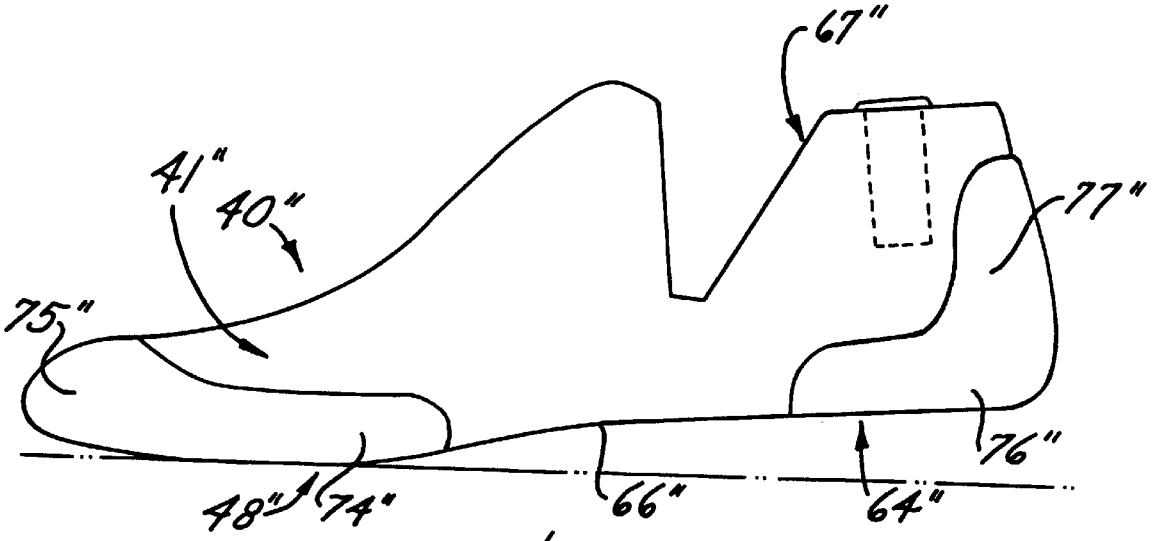
FIG. 29 is a side view of an alternative embodiment of a shoe last according to the present invention.

Further embodiments of the method of construction utilize a last 40" and levelers 140, 141 as illustrated in FIGS. 27 through 29. In this embodiment, the last 40" includes a body 41" having a backpart 64" and a forepart 48" as described in reference to the embodiment of the last 40. The last 40" also includes and a last upper portion 67" having a toe upper portion 75", side interface bulging portions 74", backpart side interface bulging portions 76", and upper heel interface bulging portions 77", all substantially similar to the last 40 and respective components described herein. The last 40", therefore, has the shoe last upper portion 67 defining a shoe last upper shape corresponding to the shape of the upper 129 of a custom-shaped sock 120 when positioned on a foot FF of a wearer as described with respect to last 40. The previous discussion of these components of last 40 is, hereby, incorporated by reference. The last 40" also includes a substantially planar last bottom portion 66" defined by lower end peripheries of the forepart 48 and the backpart 64.

The last bottom portion 66" is adapted to receive one of a plurality of levelers 140, 141 having a shape corresponding to the bottom shape of a custom-shaped sock 120 positioned on the foot FF of a wearer. The last bottom portion 66", therefore, does not include a ball interface bulging portion, toe interface portion, and heel interface bulging portion such as the ball interface bulging portion 68, toe interface portion 69, and heel interface bulging portion 70 of last 40.

In FIG. 27, two levelers 140, 141 are shown. In this method of using the last 40" to construct a shoe 150", a quantity of levelers is provided depending on the configuration of the sole 151 being utilized to construct the shoe 150. Thus, various quantities and configurations of levelers depending on the sole can be utilized.

In FIGS. 27 and 28, the levelers 140, 141 each have a thickness between an upper surface 142, 143 and a lower surface 144, 145 of about one-eighth of an inch. The thickness of the levelers 140, 141 corresponds to the thickness of the thickened fabric areas of the heel portion or the ball portion of the custom-shaped sock. The levelers 140, 141 each have upper peripheries which define the shape of the upper surface 142, 143 of the levelers 140, 141 and lower peripheries which define the shape of the lower surface 144, 145 of the levelers 140, 141. The shape of the levelers 140, 141 proportionally corresponds to the shape of the thickened fabric portions of the heel and ball portions 121, 122 of the custom-shaped sock 120 and to the configuration of the sole 151". The sole 151" includes an innersole 151*a*" and an outersole 151*b*". The innersole 151*a*" includes the components such as the recessed heel area 154" described herein with reference to the sole 151". The levelers are readily interchangeable depending on the shoe 150" desired. The levelers 140, 141 are each provided with different thicknesses and/or configurations which proportionally correspond to the configuration and thickness of the custom-shaped sock and sole to be utilized.

This alternative embodiment of constructing a shoe to be worn and matingly interfaced with a custom-shaped sock comprises the steps of positioning an upper surface of at least one leveler, and preferably two levelers 140, 141 as shown in FIG. 27, so as to abuttingly contact and matingly interface with the last bottom portion 66" of last 40". The last bottom portion 66" and levelers 140, 141 define a shoe forming bottom having a shape corresponding to the bottom shape of the custom-shaped sock 120 positioned on the foot FF of a wearer as described herein.

The innersole 151*a*" of the sole 151" is then positioned to abuttingly contact and matingly interface with the last bottom portion 66" and the lower surface 144, 145 of the levelers 140, 141. A shoe upper 152", as described, is then positioned on the last bottom portion 66" and levelers 140, 141 as described previously. The shoe is then completed and the last 66" and levelers 140, 141 are removed from the constructed shoe. The resultant shoe 150" has a sole 151" for abuttingly contacting and matingly interfacing with a custom-shaped sock 120 when positioned on the foot FF of a wearer.

In the drawings and specification, there have been disclosed typical preferred embodiments of the invention and, although specific terms are employed, they are used in a generic and descriptive sense only and not for the purposes of limitation, the scope of the invention being set forth in the following claims.

That which is claimed is:

1. A shoe last for forming a shoe which is particularly constructed to be worn with and matingly interface with a wearer's custom-shaped sock having thickened portions in predetermined regions, the shoe last comprising:

a body having a backpart and a forepart connected to said backpart and extending forwardly therefrom, each of said backpart and said forepart having a last upper portion and a last bottom portion, said last bottom portion defined by lower end peripheries of said forepart and said backpart for abuttingly contacting and interfacing with a sole of a shoe, said forepart having a toe portion defining a toe shape of the shoe last and the upper portion of said forepart having side peripheries defining a side forepart shape of the shoe last, the last upper portion of said backpart having heel portions defining a heel shape of the shoe last and backpart side peripheries defining a side shape of the shoe last upper portion, said last bottom portion including a last bottom featherline defining an outer bottom shape of the shoe last, said last including bulging regions along said last bottom portion and at least two of said toe upper portion, side peripheries of said forepart, heel portion side peripheries and backpart side peripheries, said bulging portions being adapted to correspond to the bottom shape of a custom-shaped sock when positioned on a foot of a wearer so that a sole of a shoe formed from the last has a custom-contoured shape for corresponding to and substantially mating with an overlying custom-shaped sock when positioned therein.

2. A shoe last as defined in claim 1 wherein said side forepart shape of the shoe last is adapted to correspond to a side shape of a custom-shaped sock when positioned on a foot of a wearer so that an upper of a shoe formed from the last has a custom-contoured side upper shape adapted to correspond to and substantially mate with an overlying custom-shaped sock when positioned therein.

3. A shoe last as defined in claim 1 wherein said heel shape of the shoe last is adapted to correspond to a heel shape of a custom-shaped sock when positioned on a foot of a wearer so that an upper of a shoe formed from the last has a custom-contoured heel upper shape for corresponding to and substantially mating with an overlying custom-shaped sock when positioned therein.

4. A shoe last as defined in claim 1 wherein said side shape of the shoe last upper portion is adapted to correspond to a side shape of a custom-shaped sock when positioned on a foot of a wearer so that an upper of a shoe formed from the last has a custom-contoured side upper shape for corresponding to and substantially mating with an overlying custom-shaped sock when positioned therein.

5. A shoe last as defined in claim 1 wherein said toe shape of the shoe last is adapted to correspond to a toe shape of a custom-shaped sock when positioned on a foot of a wearer so that a toe portion of a shoe formed from the last has a custom-contoured toe upper shape for corresponding to and substantially mating with an overlying custom-shaped sock when positioned therein.

6. A shoe last for forming a shoe which is particularly constructed to be worn with and matingly interface with a wearer's sock having thickened fabric formed in the heel and ball portions thereof and relatively thinner fabric formed in an arch portion interconnecting the heel and ball portions, the shoe last comprising:

a body having a backpart and a forepart connected to said backpart and extending forwardly therefrom, each of said backpart and said forepart having a last upper portion and a last bottom portion, said last bottom portion defined by lower end peripheries of said forepart and said backpart for abuttingly contacting and interfacing with a sole of a shoe, said last bottom portion including a last bottom featherline for defining an outer bottom shape of the shoe last, a base plane forming a primary horizontal attitude for said body, a last centerline plane extending generally perpendicular to the base plane, a heel featherline plane extending generally perpendicular to the last centerline plane, and a forepart featherline plane extending generally perpendicular to the last centerline plane, said forepart including a ball interface bulging portion having lower peripheries extending along said last bottom portion for abuttingly contacting and interfacing with a ball portion of a sole of a shoe, a toe interface portion connected to a proximal end of said ball portion and extending forwardly therefrom, said toe interface portion having lower peripheries extending along said last bottom portion for abuttingly contacting and interfacing with a toe portion of a sole of a shoe, and a forepart upper portion connected to said ball interface bulging and toe interface portions for abuttingly contacting and interfacing with a shoe upper, said backpart including a heel interface bulging portion having lower peripheries extending along said last bottom portion for abuttingly contacting and interfacing with a heel portion of a sole of a shoe, and a backpart upper portion connected to at least said heel interface bulging portion for abuttingly contacting and interfacing with a shoe upper, said last bottom portion including a recessed arch shank interface portion connected to a proximal end of said heel interface bulging portion in said backpart and extending forwardly therefrom along said last bottom portion into said forepart for abuttingly contacting and interfacing with a raised arch portion of a sole of a shoe, wherein said heel interface bulging portion extends downwardly from the heel featherline plane toward the base plane a predetermined distance and is adapted to at least correspond to the downwardly extending thickened cushioned areas of a wearer's sock having thickened fabric formed in at least the heel portion thereof so as to form a heel last bottom portion of said backpart, wherein said ball interface bulging portion extends downwardly from a forepart featherline plane toward the base plane a predetermined distance adapted to at least correspond to the downwardly extending thickened cushioned areas of a wearer's sock having thickened fabric formed in at least the ball portion thereof, so as to form a ball last bottom portion of said forepart, and wherein said recessed arch shank interface portion is spaced apart from the base plane a predetermined distance adapted to at least correspond to the downwardly extending ball and heel interface bulging portions so as to form a recessed arch shank last bottom extending from said backpart into said forepart, and wherein said heel and ball interface bulging portions of said last bottom portion protrude outwardly throughout respective substantial extents thereof and said recessed arch shank interface portion has major portions thereof being substantially flat and distal fore and aft portions of said recessed arch shank interface portions being outwardly inclined toward said heel and ball interface bulging portions, such that the shoe sole formed from said shoe last more comfortably receives thickened knit fabric areas of the side ball and toe portions of a knit sock to thereby provide more comfort to the wearer of the shoe constructed from said last.

7. A shoe last as defined in claim 6, wherein the downwardly extending predetermined distance of each of said ball and heel interface bulging portions is at least about one-eighth of an inch.

8. A shoe last as defined in claim 6, wherein said forepart upper portion includes side interface bulging portions extending along side peripheries of said forepart of said body for abuttingly contacting and interfacing side peripheries of a shoe upper, said side interface bulging portions extending outwardly a predetermined distance from a last centerline plane and having a predetermined thickness adapted to correspond to the laterally extending thickened cushioned areas of a wearer's sock having thickened fabric portions formed in at least one of the side portions of the ball and toe upper portion so as to form side recessed areas in the shoe upper so that the shoe upper formed therefrom is enabled to more comfortably receive thickened knit fabric areas of the bulging side portions of a knit sock and thereby provide more comfort to the wearer of the shoe constructed from the last.

9. A shoe last as defined in claim 8, wherein said recessed arch shank interface portion extends from a proximal end of the heel portion in said backpart along the last bottom portion into said forepart, so that the transition point at the proximal end of said arch shank portion defines a last ball break, said shoe last having a predetermined ball girth circumferentially extending from said last ball break around the lower, side and upper peripheries of said last body and thereby defining an increased dimension around the last passing through said last ball break.

10. A shoe last according to claim 9, wherein respective said side interface bulging portions and said ball interface bulging portion of said forepart increase the ball girth a predetermined circumference, said predetermined ball girth circumference being selected to correspond to the thickened ball girth of a human foot of a corresponding size wearing a wearer's fabric sock having thickened cushioned areas formed in at least the ball portion or upper portions thereof.

11. A shoe last according to claim 10, wherein respective said side interface bulging portions and said ball interface forming portion of said forepart increase the ball girth circumference of said last by about 3/16 of an inch, said predetermined ball girth circumference corresponding to the thickened ball girth of a human foot of a corresponding size with a wearer's fabric sock having thickened cushioned areas formed in at least the ball portion or forepart upper portions thereof.

12. A shoe last as defined in claim 6, and wherein said backpart upper portion includes backpart side interface bulging portions extending laterally along side peripheries of said backpart upper portion for abuttingly contacting and interfacing side heel peripheries of a shoe upper from first side peripheries rearward along heel peripheries of said backpart upper portion and continuing along second side peripheries of said backpart upper portion, said backpart side interface bulging portions generally anterior of said shank portion, said backpart side interface bulging portions extending a predetermined distance from said last centerline, said backpart side interface bulging portions having a thickness at least corresponding to the laterally extending thickened cushioned areas of a wearer's sock having thickened fabric formed in at least one of the side portions and back portion of the heel upper and side upper thereof.

13. A shoe last as defined in claim 6, wherein said recessed arch shank interface portion of said last bottom portion has oppositely inclined fore and aft portions adjacent respective peripheries of said heel interface bulging portion and ball interface bulging portion so that the shoe formed thereon may comfortably be worn with a sock having thickened fabric areas in the heel and ball portions thereof and a relatively thin fabric area in the arch portion therebetween.

14. A shoe last according to claim 6, wherein proximal portions of said heel and ball interface bulging portions terminate in substantially straight lines with their respective junctures to said recessed arch shank interface portion, and wherein said respective straight line junctures are substantially parallel to each other to thereby correspond to substantially parallel junctures of proximal portions of heel and ball portions of a knit sock to be worn with a shoe particularly constructed from said shoe last.

15. A shoe last according to claim 6, wherein said body includes a heel curve base line defined by a line drawn between a heel point and a backseam tack point, said line perpendicular to a portion of said last centerline plane, wherein said backpart of said body portion further comprises an upper heel interface bulging portion protruding outwardly along the heel curve of said backpart upper portion and extending a predetermined distance from said last bottom featherline to an upper portion of said backpart upper portion, said upper heel interface bulging portion extending outwardly a predetermined distance from said heel curve base line, said predetermined distance corresponding to thickened cushioned areas of a wearer's sock having thickened fabric portions formed in at least the heel portion of the sock upper thereof so as to form a heel upper portion of said backpart opposite said last bottom portion so that a heel portion of the shoe upper of the shoe constructed from the last more comfortably receives the thickened knit pile area of the heel portion of the knit sock.

16. A shoe last according to claim 6, wherein said body portion further comprises a toe interface portion protruding outwardly and extending the entire widthwise extent of said body last upper portion so that a toe portion of the shoe upper of the shoe constructed from the last more comfortably receives a thickened knit fabric portion of a toe portion of the knit sock.

17. A shoe last for forming a shoe, the shoe last comprising:

a body having a backpart and a forepart connected to said backpart and extending forwardly therefrom, each of said backpart and said forepart having a last upper portion and a last bottom portion, said last bottom portion defined by lower end peripheries of said forepart and said backpart for abuttingly contacting and interfacing with a sole of a shoe, said last bottom portion including a last bottom featherline for defining an outer bottom shape of the shoe last, a base plane forming a primary horizontal attitude for said body, a last centerline plane extending generally perpendicular to the base plane, a heel featherline plane extending generally perpendicular to the last centerline plane, and a forepart featherline plane extending generally perpendicular to the last centerline plane, said forepart including a ball interface bulging portion having lower peripheries extending along said last bottom portion for abuttingly contacting and interfacing with a ball portion of a sole of a shoe, a toe interface portion connected to a proximal end of said ball portion and extending forwardly therefrom, said toe interface portion having lower peripheries extending along said last bottom portion for abuttingly contacting and interfacing with a toe portion of a sole of a shoe, and a forepart upper portion connected to said ball interface bulging and toe interface portions for abuttingly contacting and interfacing with a shoe upper, said backpart including a heel interface bulging portion having lower peripheries extending along said last bottom portion for abuttingly contacting and interfacing with a heel portion of a sole of a shoe, and a backpart upper portion connected to at least said heel interface bulging portion for abuttingly contacting and interfacing with a shoe upper, said last bottom portion including a recessed arch shank interface portion connected to a proximal end of said heel interface bulging portion and extending forwardly therefrom along said last bottom portion for abuttingly contacting and interfacing with a raised arch portion of a sole of a shoe, wherein said heel interface bulging portion extends downwardly from the heel featherline plane toward the base plane a predetermined distance so as to form the heel portion of the last bottom portion, wherein said ball interface bulging portion extends downwardly from a forepart featherline plane toward the base plane a predetermined distance so as to form the ball portion of said last bottom portion, wherein said recessed arch shank interface portion is spaced apart from the base plane a predetermined distance at least corresponding to the downwardly extending ball and heel interface bulging portions so as to form a recessed arch shank interface portion of said last bottom portion, and wherein proximal portions of said heel and ball interface bulging portions terminate in substantially straight lines with their respective junctures with said recessed arch shank interface portion, and said respective straight line junctures are substantially parallel to each other.

18. A shoe last as defined in claim 17, wherein the downwardly extending predetermined distance from the forepart featherline plane and heel featherline plane of each of said ball and heel interface bulging portions is at least about one-eighth of an inch.

19. A shoe last as defined in claim 17, wherein said forepart upper portion includes forepart side interface bulging portions extending along side peripheries of said forepart of said body for abuttingly contacting and interfacing side peripheries of a shoe upper, said forepart side interface bulging portions extending outwardly a predetermined distance from a last centerline plane and having a predetermined thickness, so as to form side recesses in the shoe upper having a greater depth than recesses in a shoe upper of a corresponding shoe style size.

20. A shoe last as defined in claim 19, wherein said recessed arch shank interface portion extends from a proximal end of the heel portion along the last bottom portion into the forepart so that the transition point at the proximal end of the shank portion defines a last ball break, said shoe last having a predetermined ball girth circumferentially extending from said last ball break around the lower, side and upper peripheries of said last body, said ball girth thereby defining an increased dimension around the last passing through the last ball break.

21. A shoe last according to claim 20, wherein said forepart side interface bulging portions and said ball interface bulging portion increase the ball girth of the shoe last.

22. A shoe last according to claim 21, wherein said forepart side interface bulging portions and said ball interface bulging portion increase the ball girth of said last by about 3/16 of an inch.

23. A shoe last as defined in claim 17, wherein said backpart upper portion includes a backpart side interface bulging portion extending laterally along side peripheries of said backpart of said body for abuttingly contacting and interfacing side heel peripheries of a shoe upper from a first side rearward along a heel portion of said backpart upper portion and continuing along a second side of said backpart upper portion, said backpart side bulging portions generally anterior of said shank portion, said backpart side bulging portions extending a predetermined distance from said last centerline, said predetermined distance greater than the distance from a last centerline to corresponding side portions of a traditional shoe last for a corresponding shoe style size.

24. A shoe last as defined in claim 17, wherein said recessed arch shank interface portion of said last bottom portion having oppositely inclined fore and aft portions adjacent respective peripheries of said heel or ball interface bulging portions.

25. A shoe last according to claim 17, wherein said heel and ball interface bulging portions of said last bottom portion protrude outwardly throughout substantially their entire extent and wherein said recessed arch shank interface portion has major portions thereof being substantially flat and distal fore and aft portions of said recessed arch shank interface portions being outwardly inclined toward said heel and ball interface bulging portions and merging therewith.

26. A shoe last according to claim 17, wherein said body includes a heel curve base line defined by a line drawn between a heel point and a backseam tack point, said line perpendicular to a portion of said last centerline plane, wherein said backpart of said body portion further comprises an upper heel interface bulging portion protruding outwardly along the heel curve of said backpart upper portion and extending a predetermined distance from said last bottom featherline to an upper portion of said backpart upper portion, said upper heel interface bulging portion extending outwardly a predetermined distance from said heel curve base line, said predetermined distance corresponding to extending thickened cushioned areas of a wearer's sock having thickened fabric portions formed in at least the heel portion of the backpart upper thereof so as to form a heel upper portion of said backpart opposite said last bottom portion so that a heel portion of the shoe upper of the shoe constructed from the last more comfortably receives the thickened fabric area of the heel portion of the sock.

27. A shoe last according to claim 17, wherein said body portion further comprises a toe interface portion protruding outwardly and extending the entire widthwise extent of said last upper portion so that a toe portion of the shoe upper of the shoe constructed from the last more comfortably receives a thickened fabric portion of a toe portion of sock.

28. A shoe last for forming a shoe which is particularly constructed to be worn with and matingly interface with a wearer's sock having thickened fabric formed in the heel and ball portions thereof and relatively thinner fabric formed in an arch portion interconnecting the heel and ball portions, the shoe last comprising:

a body having a backpart and a forepart connected to said backpart and extending forwardly therefrom, each of said forepart and said backpart having a last upper portion and a last bottom portion, said last bottom portion defined by lower end peripheries of said forepart and said backpart for abuttingly contacting and interfacing with a sole of a shoe, said last bottom portion including a last bottom featherline for defining a bottom shape of the shoe last, a base plane forming a primary horizontal attitude for said body, a last centerline plane extending generally perpendicular to the base plane, a heel featherline plane extending generally perpendicular to the last centerline plane, and a forepart featherline plane extending generally perpendicular to the last centerline plane, said forepart including a ball interface portion having lower peripheries extending along said last bottom portion for abuttingly contacting and interfacing with a ball portion of a sole of a shoe, a toe interface portion connected to a proximal end of said ball portion and extending forwardly therefrom, said toe interface portion having lower peripheries extending along said last bottom portion for abuttingly contacting and interfacing with a toe portion of a sole of a shoe, and a forepart upper portion connected to said ball interface and toe interface portions for abuttingly contacting and interfacing with a shoe upper, said backpart including a heel interface portion having lower peripheries extending along said last bottom portion for abuttingly contacting and interfacing with a heel portion of a sole of a shoe and a backpart upper portion connected to at least said heel interface portion for abuttingly contacting and interfacing with a shoe upper, said last bottom portion including a recessed arch shank interface portion connected to a proximal end of said heel interface portion and extending forwardly therefrom along said last bottom portion for abuttingly contacting and interfacing with a raised arch portion of a sole of a shoe, wherein the recess forming said recessed arch shank interface portion extends upwardly from the base plane a predetermined distance above lower peripheries of said heel interface portion and ball interface portion, and the heel and ball interface bulging portions terminate in substantially straight lines with their respective junctures with the recessed arch shank interface portion and the respective straight line junctures are substantially parallel to each other, so that the predetermined upwardly extending distance substantially corresponds to the downwardly extending distance of thickened fabric areas of a wearer's sock having thickened fabric areas formed in at least the heel portion and the ball portion and thinner fabric areas formed in the arch portion thereof so that a shoe sole formed therefrom more comfortably receives thickened fabric areas of the ball and heel portions of a wearer's sock and thereby provide more comfort to the wearer of the shoe constructed from said last.

29. A shoe last as defined in claim 28, wherein said recessed arch shank interface portion is spaced apart at least one-eighth of an inch greater than the distance between an arch portion and lower peripheries of a heel and last bottom portion of a traditional shoe last for corresponding shoe style size corresponding to the thickness of the fabric areas formed in the heel and ball portion of the wearer's sock having thickened fabric areas formed in the heel and ball portions and thinner fabric portions in the arch portion.

30. A shoe last for forming a shoe which is particularly constructed to be worn with and matingly interface with a wearer's custom-shaped sock, the shoe last comprising:

a body having a backpart and a forepart connected to said backpart and extending forwardly therefrom, each of said forepart and said backpart having a shoe last upper portion defining a shoe last upper portion substantially corresponding to the shape of the upper of a custom-shaped sock when positioned on a foot of a wearer so that an upper of a shoe formed from the last has a custom-contoured shape corresponding to an adjacent custom-shaped sock when positioned therein, said forepart having a toe portion defining a toe shape of the shoe last, side peripheries defining a side forepart shape of the shoe last and said upper portion of said backpart having heel portions defining a heel shape of the shoe last and backpart side peripheries defining a side shape of the shoe last upper portion, and having a substantially planar last bottom portion defined by lower end peripheries of said forepart and said backpart, said last bottom portion including at least one of a plurality of interchangeable levelers, each leveler being adapted to expand the dimension of a portion of the last to form bulging regions along at least two of said toe upper portion, side peripheries of said forepart, heel portions and backpart side peripheries, a shape corresponding to the bottom shape of a custom-shaped sock positioned on the foot of a wearer, so that a sole of a shoe formed from the last and said levelers has a custom-contoured shape corresponding to and substantially mating with an overlying custom-shaped sock when positioned therein.

31. A shoe last as defined in claim 30, wherein said substantially planar last bottom portion comprises a heel portion and ball portion, each of said heel portion and ball portion including at least one of a plurality of interchangeable levelers, each of said levelers having a shape corresponding to the bottom shape of a custom-shaped sock having thickened fabric areas in the heel and ball portions thereof positioned on the foot of a wearer, so that a sole of a shoe formed from the last and said levelers positioned thereon in said heel portion and said ball portion has a custom-contoured shape adapted to correspond to and substantially mate with an overlying custom-shaped sock when positioned thereon.

* * * * *